US007949288B2

(12) United States Patent
Takiguchi et al.

(10) Patent No.: US 7,949,288 B2
(45) Date of Patent: May 24, 2011

(54) IMAGE FORMING AGENT STORAGE DEVICE AND IMAGE FORMING APPARATUS

(75) Inventors: Toshio Takiguchi, Saitama (JP); Shigeki Nishimura, Saitama (JP); Kazuaki Sugawara, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 14 days.

(21) Appl. No.: 12/606,456

(22) Filed: Oct. 27, 2009

(65) Prior Publication Data

US 2010/0290817 A1 Nov. 18, 2010

(30) Foreign Application Priority Data

May 15, 2009 (JP) ..... 2009-118407

(51) Int. Cl.
*G03G 15/08* (2006.01)

(52) U.S. Cl. ..... 399/258; 399/260

(58) Field of Classification Search ..... 399/258–262; 222/DIG. 1

See application file for complete search history.

(56) References Cited

U.S. PATENT DOCUMENTS

| | | | | |
|---|---|---|---|---|
| 5,933,691 | A | 8/1999 | Johroku | |
| 6,292,644 | B1 | 9/2001 | Goto et al. | |
| 7,596,338 | B2 * | 9/2009 | Mihara | 399/106 |
| 7,738,818 | B2 * | 6/2010 | Murakami et al. | 399/258 |
| 2006/0104660 | A1 | 5/2006 | Doi et al. | |
| 2009/0129827 | A1 | 5/2009 | Ichikawa et al. | |

FOREIGN PATENT DOCUMENTS

| | | | |
|---|---|---|---|
| JP | 10-142915 | A | 5/1998 |
| JP | 2000-162861 | A | 6/2000 |
| JP | 2002-139903 | A | 5/2002 |
| JP | 2005-107141 | A | 4/2005 |
| JP | 2005-134452 | A | 5/2005 |
| JP | 4217920 | B1 | 11/2008 |
| JP | 2009-122559 | A | 6/2009 |

OTHER PUBLICATIONS

Japanese Office Action dated Jun. 4, 2009 in Japanese Patent Appln. No. 2009-118407.

Russian Office Action issued on Feb. 14, 2011 in the corresponding Russian Patent Application No. 2009146975.

* cited by examiner

*Primary Examiner* — Hoang Ngo

(74) *Attorney, Agent, or Firm* — Sughrue Mion, PLLC

(57) ABSTRACT

An image forming agent storage device includes an image forming agent storage body that is inserted into an insertion part, an opening-and-closing member, an engagement mechanism and an engagement release prevention mechanism. The image forming agent storage body is formed with a discharge port. The engagement mechanism includes an engagement part being provided in the image forming agent storage body and an engaged part being provided in the opening-and-closing member and being capable of engaging with the engagement part. The engagement release prevention mechanism prevents that a state where the engagement part and the engaged part can engage with each other is released due to an event that a front side of the opening-and-closing member moves relative to the image forming agent storage body so as to slant in a direction away from a position where the engagement part and the engaged part are provided.

12 Claims, 23 Drawing Sheets

IMAGE FORMING AGENT STORAGE DEVICE AND IMAGE FORMING APPARATUS

CROSS-REFERENCE TO RELATED APPLICATIONS

This application is based on and claims priority under 35 USC 119 from Japanese Patent Application No. 2009-118407 filed May 15, 2009.

BACKGROUND

Technical Field

This invention relates to an image forming agent storage device and an image forming apparatus.

SUMMARY

According to an aspect of the invention, an image forming agent storage device includes an image forming agent storage body, an opening-and-closing member, an engagement mechanism and an engagement release prevention mechanism. The image forming agent storage body is inserted into an insertion part provided in an image forming apparatus main body. The image forming agent storage body stores an image forming agent. The image forming agent storage body is formed with a discharge port for discharging the stored image forming agent. When the image forming agent storage body is inserted into the insertion part, the opening-and-closing member opens the discharge port in association with a move of the image forming agent storage body in an insertion direction in which the image forming agent storage body is inserted into the insertion part. When the image forming agent storage body is pulled out from the insertion part, the opening-and-closing member closes the discharge port in association with a move of the image forming agent storage body in an opposite direction to the insertion direction. The engagement mechanism includes an engagement part and an engaged part. The engagement part is provided in the image forming agent storage body. The engaged part is provided in the opening-and-closing member and being capable of engaging with the engagement part. If a state where the engagement part and the engaged part can engage with each other is released, the engagement mechanism allows the opening-and-closing member to open. The engagement mechanism prevents the opening-and-closing member from opening in the state where the engagement part and the engaged part can engage with each other. The state where the engagement part and the engaged part can engage with each other is released in association with an event that the opening-and-closing member moves in a direction crossing the insertion direction relative to the image forming agent storage body from the state where the engagement part and the engaged part can engage with each other. The engagement release prevention mechanism prevents that the state where the engagement part and the engaged part can engage with each other is released due to an event that a front side, based on a direction in which the opening-and-closing member moves to open the discharge port, of the opening-and-closing member moves relative to the image forming agent storage body so as to slant in a direction away from a position where the engagement part and the engaged part are provided.

BRIEF DESCRIPTION OF THE DRAWINGS

Exemplary embodiments of the invention will be described in detail below based on the accompanying drawings, wherein

FIG. 3A is a sectional view to show a state where the opening-and-closing member is placed at a position where the opening-and-closing member seals a discharge port, and FIG. 3B is a sectional view to show a state where the opening-and-closing member is placed at a position where the opening-and-closing member opens the discharge port;

FIG. 11A shows a state where an engagement part and an engaged part can engage with each other, and FIG. 11B shows that the state where the engagement part and the engaged part can engage with each other is released;

DETAILED DESCRIPTION

Exemplary embodiments of the invention will be described in detail with reference to the accompanying drawings.

Figure 1:
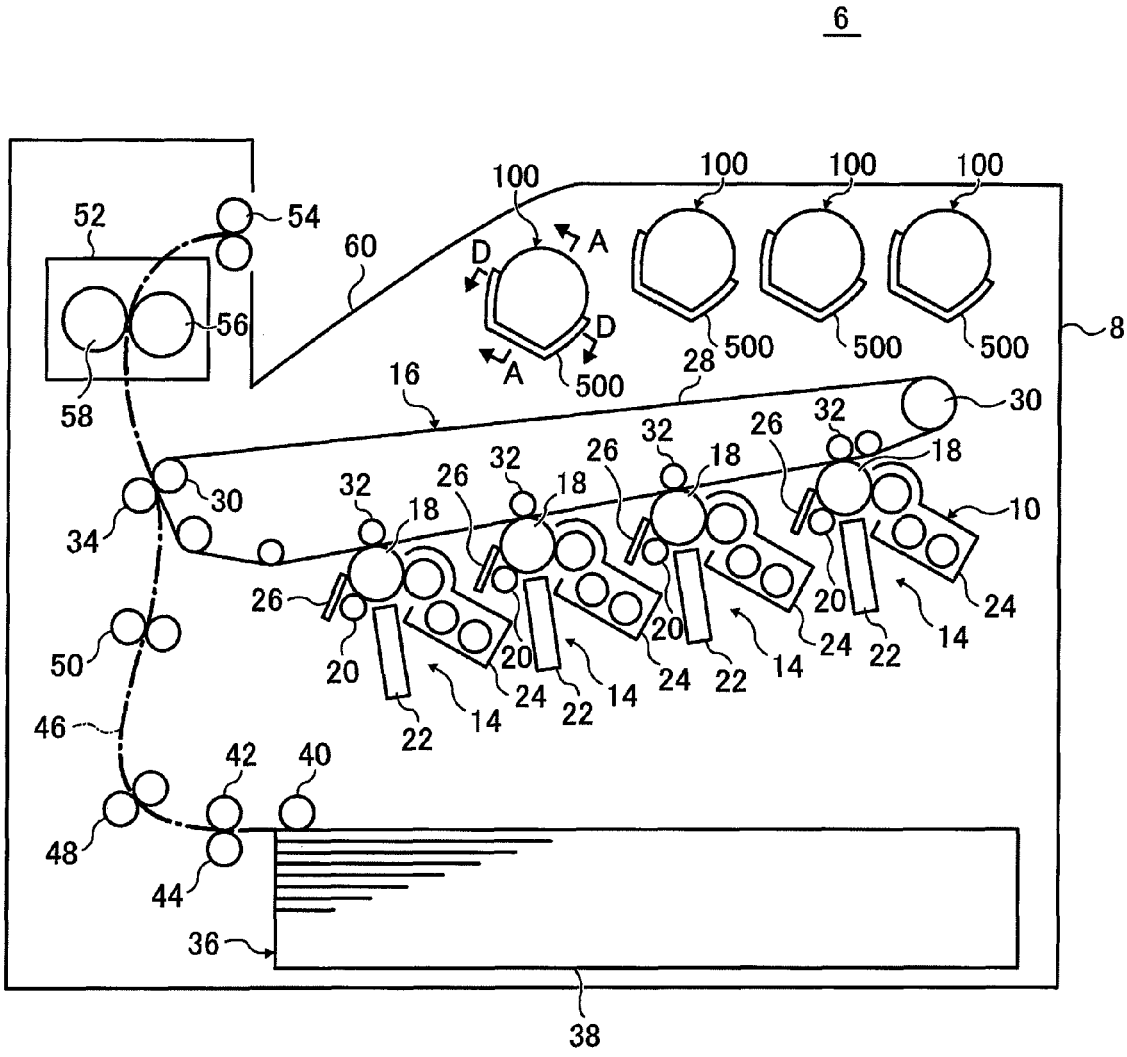
FIG. 1 is a side view to show an image forming apparatus according to a first exemplary embodiment of the invention.

FIG. 1 shows an image forming apparatus 6 according to a first exemplary embodiment of the invention. The image forming apparatus 6 has an image forming apparatus main body 8. An image forming section 10, a sheet feeder 36, and (for example, four) insertion parts 500 into which image forming agent storage devices 100 which will be described later are inserted are provided in the image forming apparatus main body 8. A sheet feeding passage 46 is formed in the image forming apparatus main body 8.

The image forming section 10 has (for example, four) image forming units 14 and a transfer unit 16. The image forming units 14 include ones for yellow, magenta, cyan, and black and are placed in parallel. Each of the image forming units 14 includes a photoconductive body 18 used as an image carrying body, a charging device 20 that has a roller and, for example, charges the photoconductive body 18, an exposure device 22 that has LEDs (light emitting diodes), for example, and forms a latent image on the photoconductive body 18, a developing device 24 that develops the latent image on the photoconductive body 18 formed by exposure device 22 with a developer, and a cleaner 26 that cleans and removes the developer remaining on the photoconductive body 18 after transfer.

The transfer unit 16 has an intermediate transfer belt 28. The intermediate transfer belt 28 rotates clockwise in FIG. 1 with being supported on plural support rolls 30. Primary transfer rolls 32 are opposed to the photoconductive bodies 18 across the intermediate transfer belt 28. A secondary transfer roll 34 is opposed to one of the support rolls 30 across the intermediate transfer belt 28.

The sheet feeder 36 is placed at the bottom in the image forming apparatus main body 8 and has a sheet feed bed 38 on which sheets are stacked, a pickup roll 40 for pulling out a sheet stacked on the sheet feed bed 38, and a feed roll 42 and a retard roll 44 for conveying the sheet while separating sheets one by one.

The sheet feeding passage 46 is formed along a roughly vertical direction in the vicinity of one end of the image forming apparatus main body 8 (in the vicinity of the left end in the figure). In the image forming apparatus main body 8, a conveying roll 48, a registration roll 50, the secondary transfer roll 34, a fixing device 52, and a discharge roll 54 are provided along the sheet feeding passage 46. The registration roll 50 temporarily stops the sheet fed to the sheet feeding passage 46 and conveys the sheet to the secondary transfer roll 34 at a proper timing. The fixing device 52 has a heating roll 56 and a pressing roll 58, and fixes a developer image on the sheet by adding heat and pressure thereto.

A discharge section 60 is provided on the top of the image forming apparatus main body 8. The sheet with the developer image fixed thereon is discharged to the discharge section 60 by the discharge roll 54, and the sheets discharged to the discharge section 60 are stacked thereon.

The four image forming agent storage devices 100 are placed above the intermediate transfer belt 28, for example, and store yellow, magenta, cyan, and black developers. The yellow, magenta, cyan, and black developers are used as image forming agents. The developers stored in the image forming agent storage devices 100 are supplied to the developing device 24 through a developer supply device (not shown).

Each of the image forming agent storage devices 100 can be attached to and detached from the image forming apparatus main body 8. More specifically, each of the image forming agent storage devices 100 is inserted into the insertion part 500 so that it is pushed from the front side of the image forming apparatus 6 (the front side in FIG. 1) to the rear (the back side in FIG. 1). Each image forming agent storage device 100, which is in a state where it is inserted in the insertion part 500, is pulled out from the back side of the image forming apparatus 6 toward the front side of the image forming apparatus 6.

Figure 2:
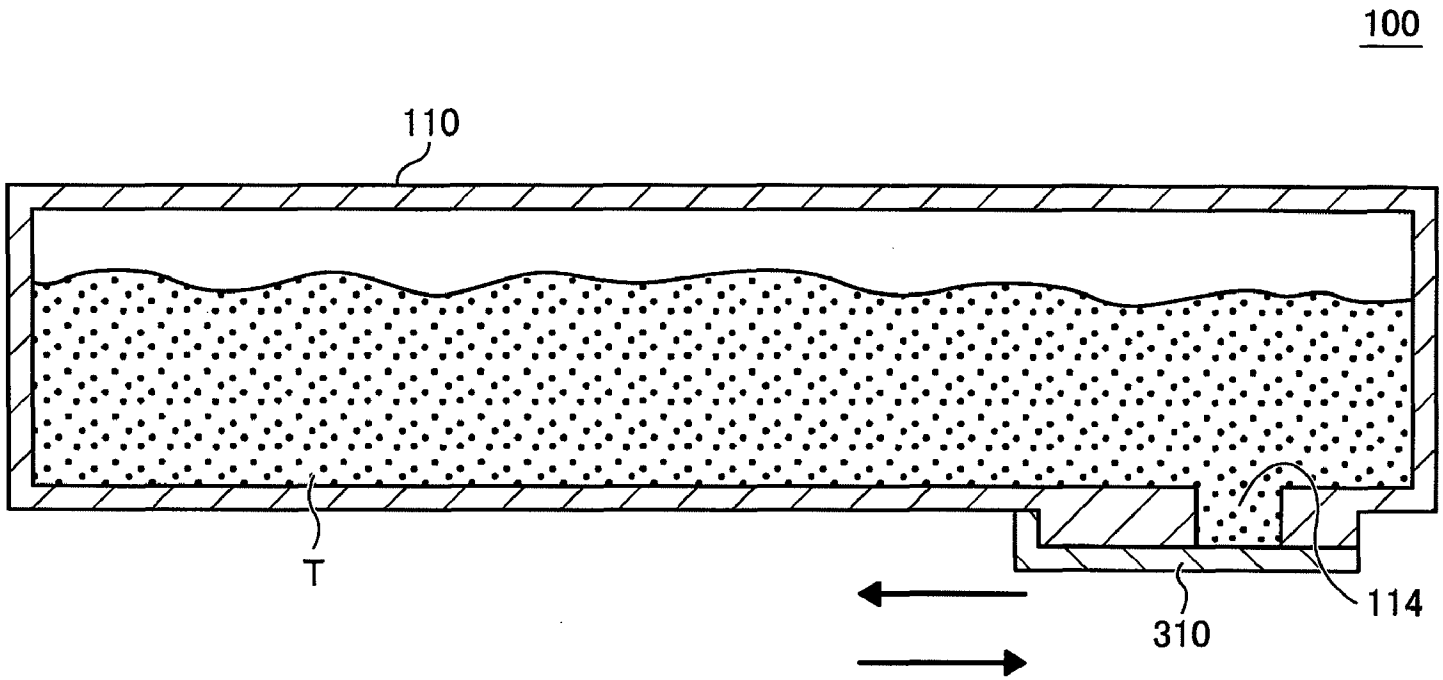
FIG. 2 is a sectional view, taken along a line A-A in FIG. 1, of an image forming agent storage device according to the first exemplary embodiment of the invention that is provided in the image forming apparatus shown in FIG. 1.

FIG. 2 schematically shows the image forming agent storage device 100.

As shown in FIG. 2, the image forming agent storage device 100 has an image forming agent storage body 110 that is used as an image forming agent storage body, and an opening-and-closing member 310. The image forming agent storage body 110 is a portion inserted that is directly into the insertion part 500 (see FIG. 1) as a part of the image forming agent storage device 100. The image forming agent storage body 110 stores a developer T. A discharge port 114 is formed downward, for example, on the bottom face of the image forming agent storage body 110. The discharge port 114 is used to discharge the developer T stored in the image forming agent storage body 110, and the developer discharged from the discharge port 114 is supplied to the developing device 24 (see FIG. 1). The discharge port 114 formed downward is not necessarily directed just downward in the vertical direction, but may be directed downward slantingly like the insertion part 500 shown in FIG. 1.

The opening-and-closing member 310 is placed so as to be able to move to the image forming agent storage body 110 and can be placed at least in a position where the opening-and-closing member 310 closes the discharge port 114, on the image forming agent storage body 110 as shown in FIG. 2.

Figure 3A:
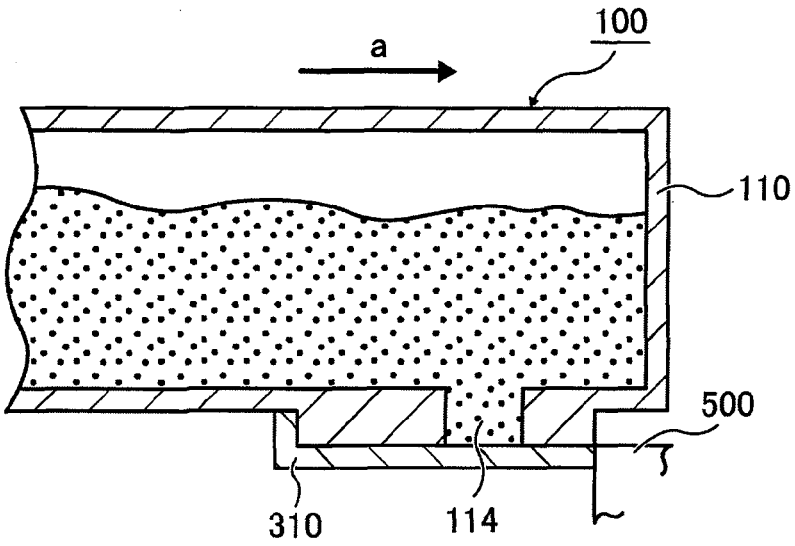
FIGS. 3A and 3B schematically show an operation of an opening-and-closing member that is provided in the image forming agent storage device shown in FIG. 2.
Figure 3B:
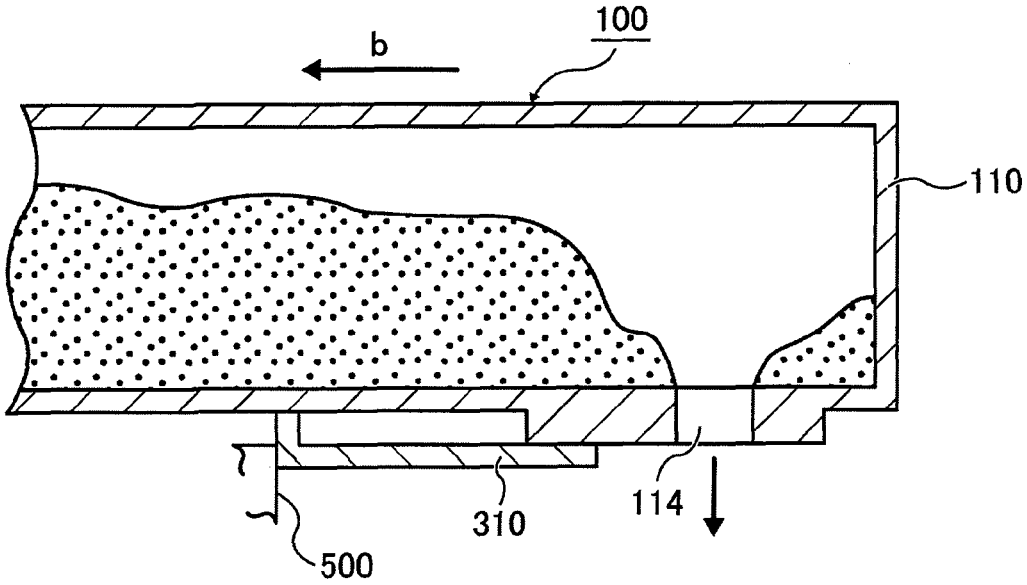

FIGS. 3A and 3B show an outline of an operation of the opening-and-closing member 310. The opening-and-closing member 310 can be placed in the position where the opening-and-closing member 310 closes the discharge port 114 as shown in FIGS. 2 and 3A, and can be placed in a position where the opening-and-closing member 310 opens the discharge port 114 as shown in FIG. 3B, that is, can move relative to the image forming agent storage body 110 at least between the closing position and the opening position. When the opening-and-closing member 310 is located at the position where the opening-and-closing member 310 opens the discharge port 114, the developer stored in the image forming agent storage body 110 is discharged so as to drop through the discharge port 114.

An arrow "a" shown in FIG. 3A indicates an insertion direction in which the image forming agent storage device 100 is inserted into the image forming apparatus main body 8.

Before the image forming agent storage device 100 is inserted into the image forming apparatus main body 8, the opening-and-closing member 310 is placed at the position where the opening-and-closing member 310 closes the discharge port 114. When the image forming agent storage body 110 is pushed into the image forming apparatus main body 8 from this state, the opening-and-closing member 310 interferes with a part of the insertion part 500 in a process in which the image forming agent storage device 100 moves, and only the image forming agent storage body 110 moves relative to the image forming apparatus main body 8 in a state where the opening-and-closing member 310 stops relative to the image forming apparatus main body 8. Thus, when the image forming agent storage body 110 is inserted into the insertion part 500, the opening-and-closing member 310 opens the discharge port 114 in association with a move of the image forming agent storage body 110 in the insertion direction.

An arrow "b" shown in FIG. 3B indicates a pulling-out direction in which the image forming agent storage device 100 is pulled out from the image forming apparatus main body 8. The opening-and-closing member 310 is placed in the position where the opening-and-closing member 310 opens the discharge port 114 in a state where the image forming agent storage device 100 is attached in the image forming apparatus main body 8. When the image forming agent storage device 100 being in this state is pulled out from the image forming apparatus main body 8, the opening-and-closing member 310 interferes with a part of the insertion part 500 in a process in which the image forming agent storage body 110 moves, and only the image forming agent storage body 110 moves relative to the image forming apparatus main body 8 in a state where the opening-and-closing member 310 stops relative to the image forming apparatus main body 8. Thus, when the image forming agent storage body 110 is pulled out from the insertion part 500, the opening-and-closing member 310 seals the discharge port 114 in association with a move of the image forming agent storage body 110 in the pulling-out direction. The operation of the opening-and-closing member 310 outlined above will be described later in detail.

Figure 4:
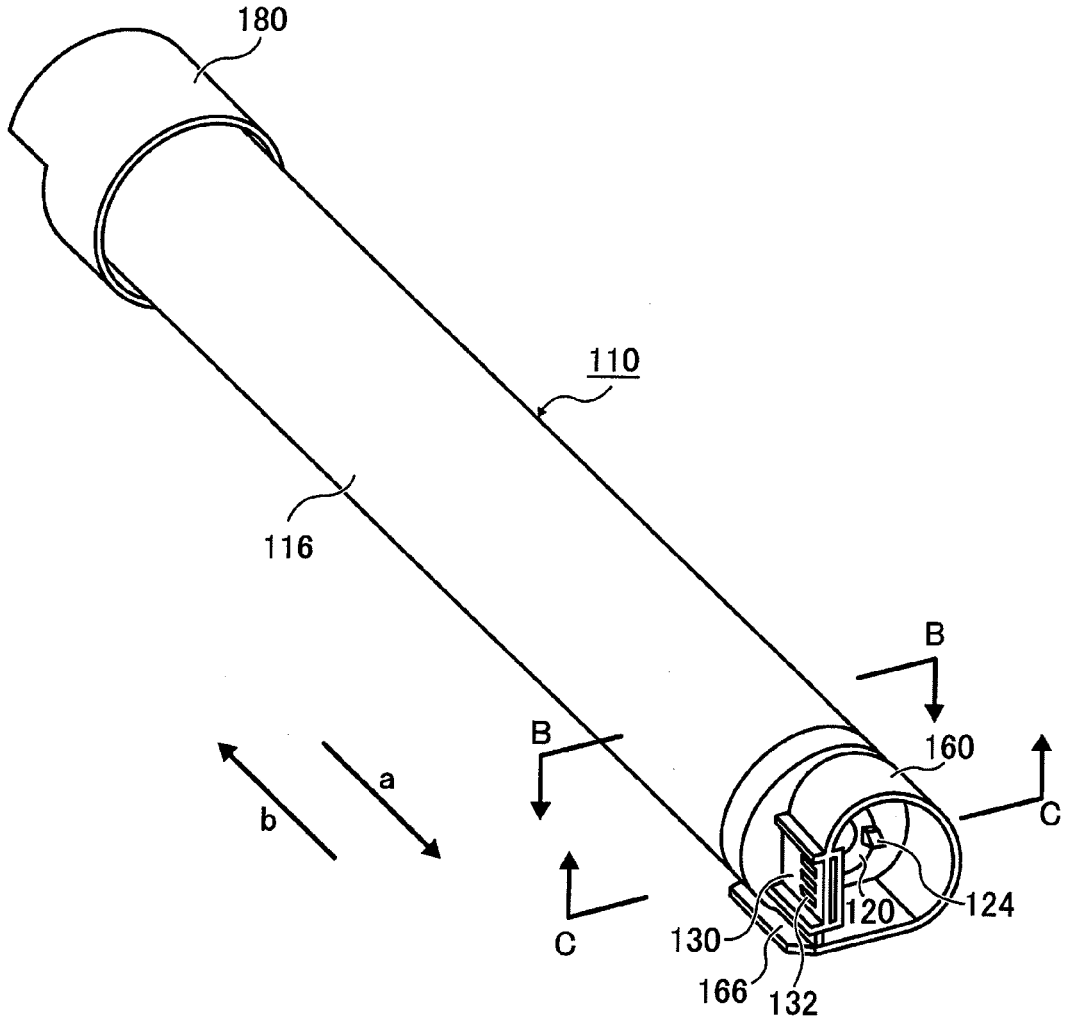
FIG. 4 is a perspective view to show an image forming agent storage body of the image forming agent storage device shown in FIG. 2.
Figure 5:
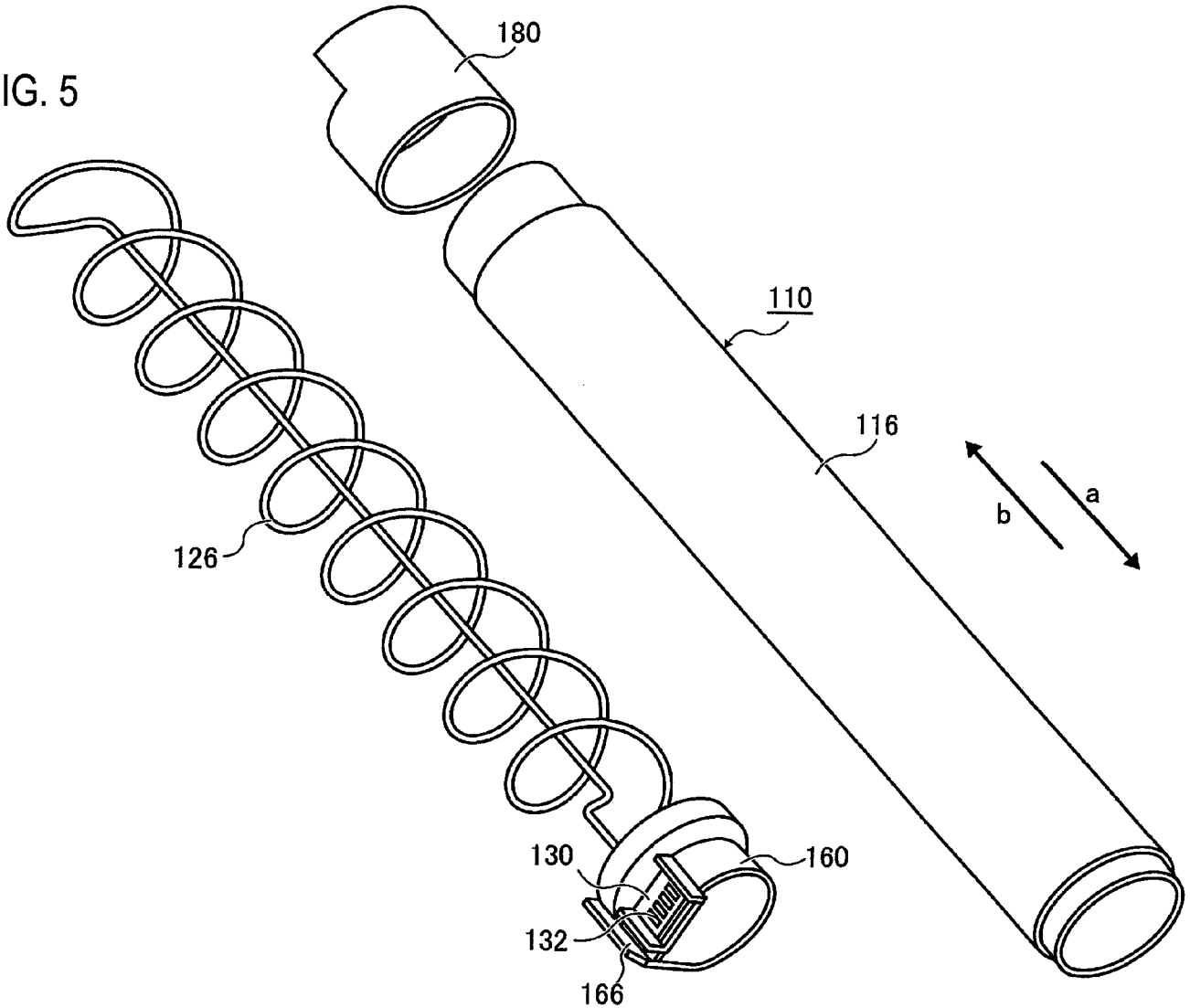
FIG. 5 is an exploded perspective view to show a disassembly state of the image forming agent storage body of the image forming agent storage device shown in FIG. 2.
Figure 6:
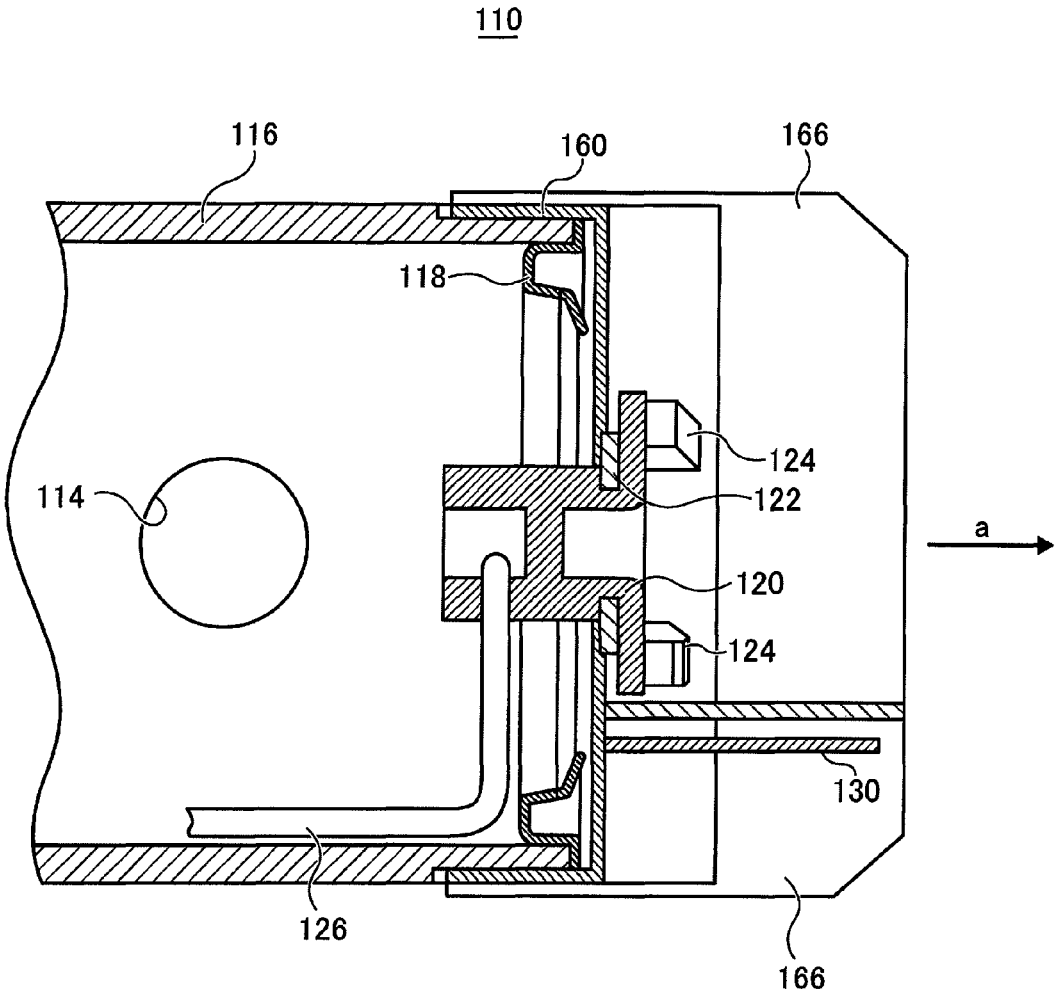
FIG. 6 is a sectional view, taken along a line B-B in FIG. 4, to show a part of the image forming agent storage body shown in FIG. 4.
Figure 7:
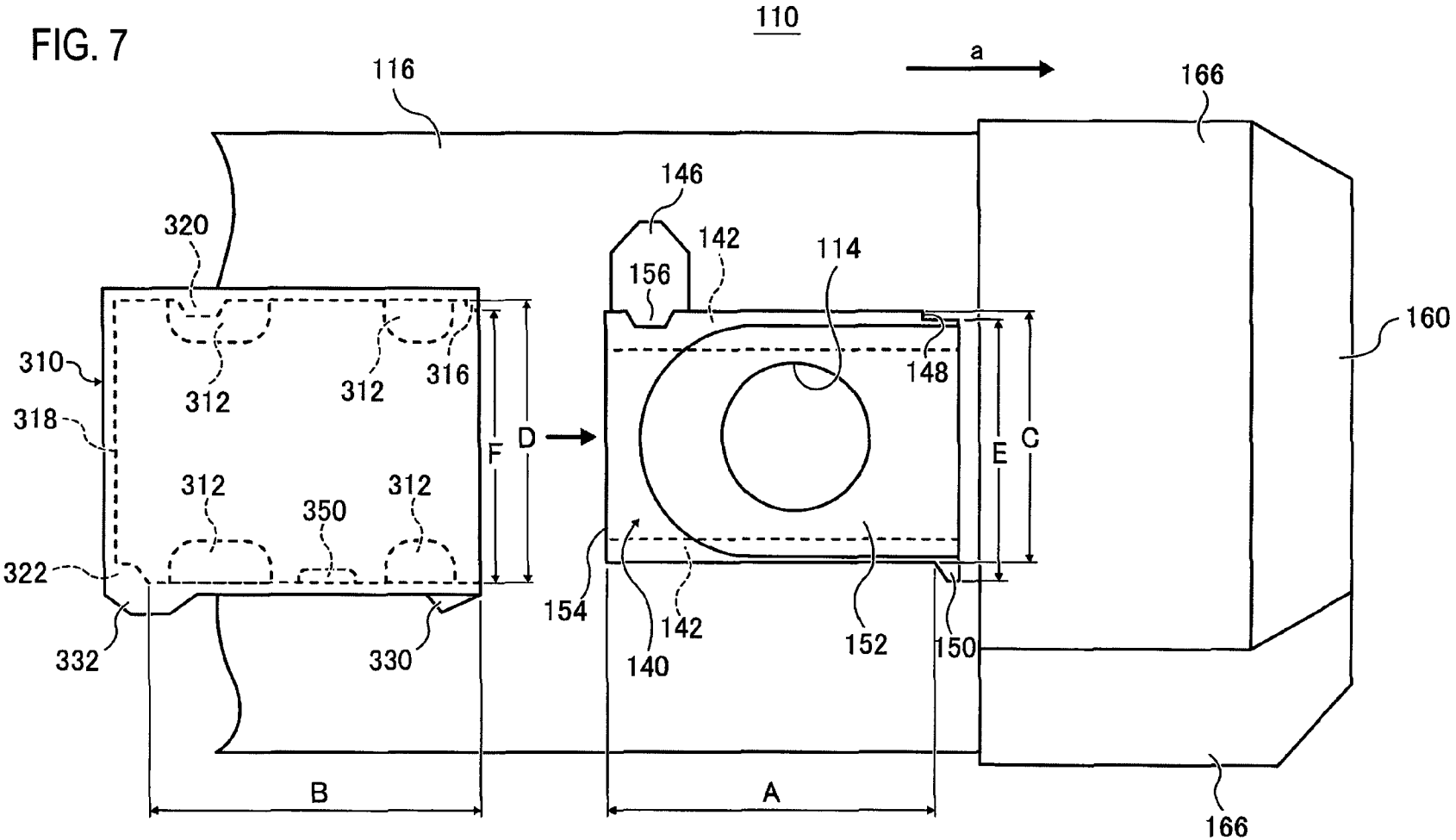
FIG. 7 is a bottom view to show a part of the image forming agent storage body shown in FIG. 4, when viewed from an arrow C-C direction shown in FIG. 4.

FIGS. 4 to 7 show the image forming agent storage body 110. FIG. 4 is a perspective view to show the image forming agent storage body 110. FIG. 5 is an exploded perspective view to show a disassembly state of the image forming agent storage body 110. FIG. 6 is a sectional view to show a part of the image forming agent storage body 110. FIG. 7 is a bottom view to show a part of the image forming agent storage body 110. FIG. 7 also shows the opening-and-closing member 310 together. For convenience, FIG. 7 shows the opening-and-closing member 310 in a state where it is removed from the image forming agent storage body 110.

As shown in FIGS. 4 to 7, the image forming agent storage body 110 has a tubular body 116 formed with the discharge port 114, which is previously described with reference to FIG. 2, a lid body 160, and a grip member 180. The tubular body 116 is roughly shaped in a cylinder. Opened is a front end side of the tubular body 116 in the insertion direction (the arrow "a" direction) in which the image forming agent storage device 100 is inserted into the insertion part 500 of the image forming apparatus main body 8. A rear end side, in the insertion direction, of the tubular body 116 is closed. An opening portion on the front end side in the insertion direction is closed by the lid body 160, and the developer is stored in a space formed by the tubular body 116 and the lid body 160. An agitation member 126 for agitating the stored developer is provided in the space formed by the tubular body 116 and the lid body 160.

The grip member 180 is fixed to the rear end side of the tubular body 116 in the insertion direction. A user can hold the grip member 180 to insert the image forming agent storage device 100 having the image forming agent storage body 110, etc., into the insertion part 500 and pull out it from the insertion part 500. The tubular body 116 may have both the front and rear end sides opened in the insertion direction in which the image forming agent storage device 100 is inserted into the insertion part 500 of the image forming apparatus main body 8 and may have both the opening portions closed to form an enclosed space. At this time, the front end side of the tubular body 116 in the insertion direction in which the image forming agent storage device 100 is inserted into the insertion part 500 is closed by the lid body 160, and the rear end side of the image forming agent storage body 110 in the insertion direction in which the image forming agent storage device 100 is inserted into the insertion part 500 is closed directly by the grip member 180 or is closed by providing a seal member (not shown) between the tubular body 116 and the grip member 180.

A first seal member 118 is provided in a joint portion between the tubular body 116 and the lid body 160. The first seal member 118 is used to closely seal the joint portion between the tubular body 116 and the lid body 160. A coupling part (first coupling) 120 is rotatably supported at the center of the lid body 160. A second seal member 122 is provided between the coupling part 120 and the lid body 160. The second seal member 122 is used to closely seal the portion between the lid body 160 and the coupling part 120.

The coupling part 120 is formed with plural coupling projections 124. Each of the coupling projections 124 is formed so as to project toward the outside of the lid body 160 in the rotation axis direction of the coupling part 120, namely, toward the insertion direction (the arrow "a" direction) in which the image forming agent storage device 100 is inserted into the insertion part 500, in other words, toward a rear side of the image forming apparatus 6 from a front side thereof. The coupling projections 124 are formed at predetermined intervals in the circumferential direction of the circumference with the rotation axis of the coupling part 120 being set as the center.

One end of the agitation member 126 is fixed to a portion of the coupling part 120 that is placed inside the lid body 160. The agitation member 126 is used to agitate the developer as described above and more particularly is used to convey the developer to the discharge port 114 (see FIG. 3) while rotating in association with a rotation of the coupling part 120 and agitating the developer stored in the tubular body 116. The agitation member 126 is formed spirally and extends in a longitudinal direction of the tubular body 116, namely, in the insertion/pulling-out direction in which the image forming agent storage device 100 is inserted into/pulled out from the insertion part 500.

A storage medium 130 is attached to the lid body 160. The storage medium 130 stores information concerning a use state of the developer, for example, information such as a predicted used amount of the developer, color information of the developer, information concerning a storage amount of the developer, information concerning manufacturing of the developer, and the like. A connection part 132 is exposed from the storage medium 130.

The lid body 160 is provided with a move regulation part 166. The move regulation part 166 is provided so as to project from one side, based on the insertion direction of the image forming agent storage device 100 indicated by the arrow "a", of the lid body 160. The move regulation part 166 is used as a projection part and is provided to project in a direction crossing the insertion direction in which the image forming agent storage device 100 is inserted into the insertion part 500 (the arrow "a" direction), for example, in a direction orthogonal to the insertion direction. The move regulation part 166 regulates a move of the image forming agent storage device 100 in the direction crossing the insertion direction in which the image forming agent storage device 100 is inserted into the insertion part 500.

The move regulation part 166 functions as a guided part when the image forming agent storage device 100 is inserted into or pulled out from the insertion part 500, and is guided to a guide part 506 (which will be described later with reference to FIG. 15) provided in the insertion part 500. The move regulation part 166 is formed in a flat plate having a predetermined length in the insertion direction of the image forming agent storage device 100 indicated by the arrow "a", for example. The predetermined length of the flat plate in the insertion direction is set slightly longer than an opening-and-closing distance (opening-and-closing stroke) of the opening-and-closing member 310 which will be described later and is set to roughly the same length as the length of the lid body 160 in the insertion direction. A front end side of the move regulation part 166 in the insertion direction in which the image forming agent storage device 100 is inserted into the insertion part 500 is formed slantingly so as to face the inside of the image forming agent storage device 100 (the inner side from the insertion direction relative to the insertion direction). The slanting shape of the front end side of the move regulation part 166 may be formed not only of a straight line, but also of a curve of a circular arc, etc.

The discharge port 114 is formed downward in the image forming agent storage body 110 as described above and more particularly is formed downward on the lower side (bottom face) which is slightly inner from the front end side of the tubular body 116 in the insertion direction (the arrow "a" direction). The position of the discharge port 114 may have an angle with respect to the vertical direction and may be directed toward the lower side (bottom face side) in comparison with the horizontal direction.

The tubular body 116 is formed in the bottom portion with an opening-and-closing member support part 140 so as to surround the discharge port 114. The opening-and-closing member support part 140 is used to support the opening-and-closing member 310 so that the opening-and-closing member 310 can move relative to the tubular body 116. The opening-and-closing member support part 140 is formed so as to project downward from the bottom face of the tubular body 116. Guide grooves 142 which are roughly parallel with the insertion direction of the image forming agent storage device 100 indicated by the arrow "a" are formed in both side parts of the opening-and-closing member support part 140. A pop-up part 146 is formed on one side of the opening-and-closing member support part 140 of the tubular body 116 (the upper side when viewed from the bottom face as shown in FIG. 7) and at a rear end, based on the insertion direction of the image forming agent storage device 100 indicated by the arrow "a", of the opening-and-closing member support part 140.

An engagement concave part 148 which is used as an engagement part is formed on one side of the opening-and-closing member support part 140 (the upper side when viewed from the bottom face as shown in FIG. 7) and at a front end portion, based on the insertion direction indicated by the arrow "a", of the image forming agent storage device 100. A guide convex part 150 is formed on the other side of the opening-and-closing member support part 140 (the lower side when viewed from the bottom face as shown in FIG. 7) and at the front end portion, based on the insertion direction indicated by the arrow "a", of the image forming agent storage device 100. A third seal member 152 is attached to the opening-and-closing member support part 140 so as to surround the discharge port 114.

An interference concave part 156 which is used as an interfered part is formed on the one side of the opening-and-closing member support part 140 (the upper side when viewed from the bottom face as shown in FIG. 7) and at the rear end side, based on the insertion direction indicated by the arrow "a", of the image forming agent storage device 100.

Figure 8:
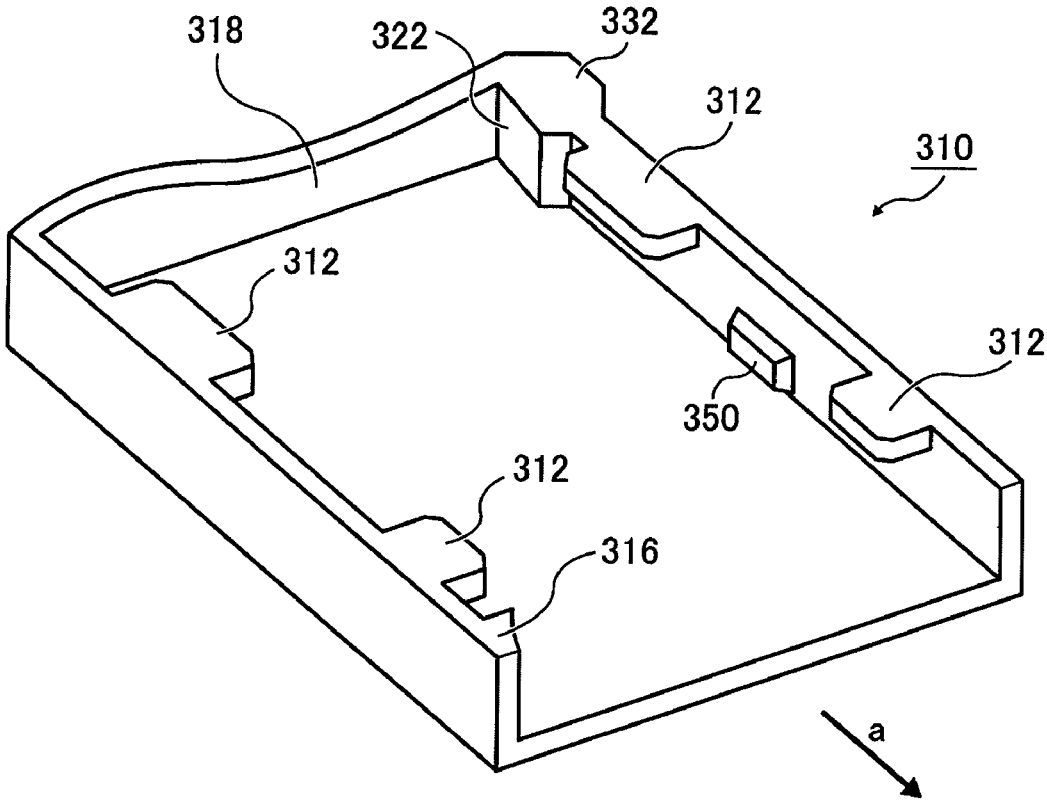
FIG. 8 is a first perspective view to show the opening-and-closing member of the image forming agent storage device shown in FIG. 2.
Figure 9:
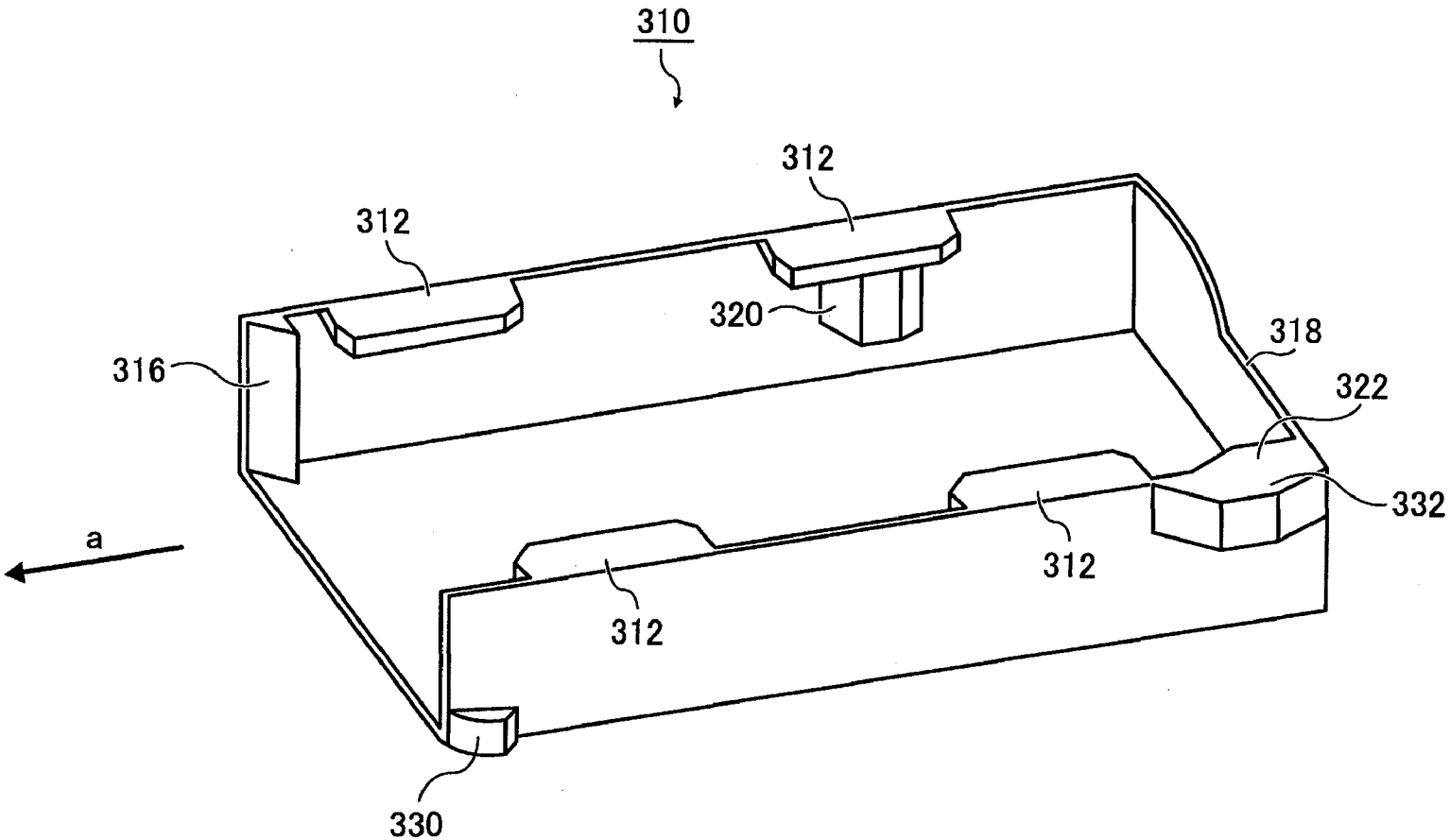
FIG. 9 is a second perspective view to show the opening-and-closing member of the image forming agent storage device shown in FIG. 2.
Figure 10:
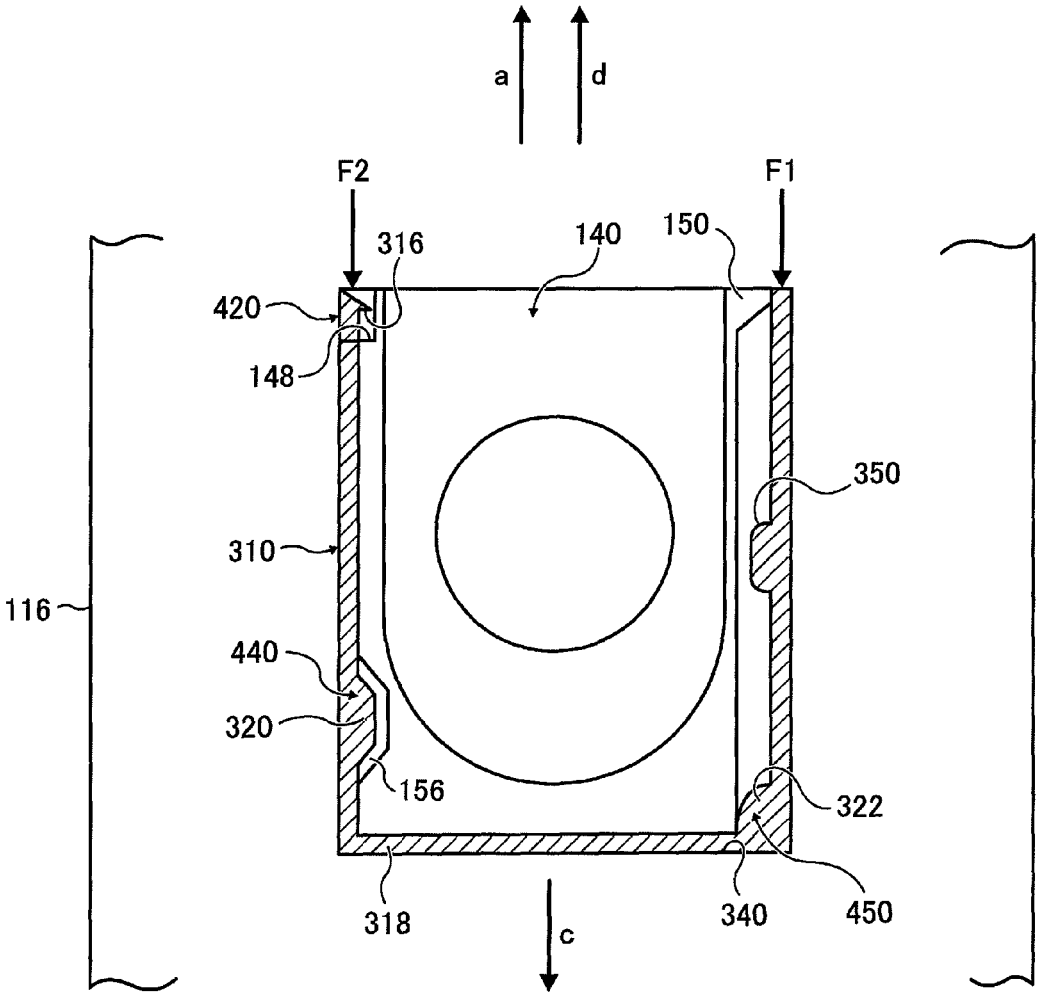
FIG. 10 is a sectional view to show a state where the opening-and-closing member of the image forming agent storage device shown in FIG. 2 is placed at the position where the opening-and-closing member seals the discharge port, when viewed from the arrow "c"-C direction shown in FIG. 4.

FIGS. 8 and 9 are perspective views to show the opening-and-closing member 310. FIG. 10 is a sectional view to show a state where the opening-and-closing member 310 is placed in the position where the opening-and-closing member 310 closes the discharge port 114 formed in the tubular body 116. The opening-and-closing member 310 will be described with reference to FIG. 7 as well as FIGS. 8 to 10.

As shown in FIGS. 7 to 10, plural guided parts 312 are formed on the inner side of the opening-and-closing member 310, which is opposed to the opening-and-closing member support part 140. Each of the guided parts 312 is formed so as to project toward the inside of the opening-and-closing member 310 in the direction orthogonal to the direction in which the image forming agent storage device 100 is inserted into the insertion part 500 (the direction indicated by the arrow "a" in FIG. 7). The guided parts 312 enter the guide grooves 142 of the opening-and-closing member support part 140. Thus, the opening-and-closing member 310 can be guided by the guide grooves 142 so as to slide on the opening-and-closing member support part 140 and can move relative to the image forming agent storage body 110 (see FIG. 3).

The width (D in FIG. 7) of the inside of the opening-and-closing member 310 in the direction orthogonal to the insertion direction indicated by the arrow "a" is formed slightly wider than the width (C in FIG. 7) of the opening-and-closing member support part 140 in the direction orthogonal to the insertion direction. Thus, the opening-and-closing member 310 can also move slightly in the direction orthogonal to the insertion direction, relative to the opening-and-closing member support part 140. The width (F in FIG. 7), based on an end part of an engagement projection 316 (described later) provided in the opening-and-closing member 310, of the inside of the opening-and-closing member 310 in the direction orthogonal to the insertion direction and the width (E in FIG. 7) between the guide convex part 150 and the engagement concave part 148, which are provided in the opening-and-closing member support part 140, are set roughly equal to each other.

A move regulation part 318 is formed at the rear end of the opening-and-closing member 310 in the insertion direction in which the image forming agent storage device 100 is inserted into the insertion part 500 (the direction indicated by the arrow "a"). The move regulation part 318 interferes with a rear end part 154 of the opening-and-closing member support part 140 in the direction indicated by the arrow "a", thereby regulating a move of the opening-and-closing member 310 in the insertion direction. The opening-and-closing member 310 closes the discharge port 114 in a state where the move regulation part 318 has moved until it abuts against the rear end part 154 of the opening-and-closing member support part 140 (see FIG. 3A). More particularly, the third seal member 152 is intervened between the opening-and-closing member 310 and the opening-and-closing member support part 140, and the opening-and-closing member 310 closes the discharge port 114.

The engagement projection 316 is formed on the inner surface side of the opening-and-closing member 310, which is opposed to the opening-and-closing member support part 140, and at the front end, which is based on the insertion direction in which the image forming agent storage device 100 is inserted into the insertion part 500 (the direction indicated by the arrow "a"), of the opening-and-closing member 310. The engagement projection 316 is used as an engaged part and is formed so as to project toward the inside of the opening-and-closing member 310 in the direction orthogonal to the insertion direction indicated by the arrow "a".

A first interference convex part 320 is formed (i) on the inner surface side of the opening-and-closing member 310, which is opposed to the opening-and-closing member support part 140, (ii) on the rear end part 154 side (see FIG. 10), which is based on the insertion direction in which the image forming agent storage device 100 is inserted into the insertion part 500 (the direction indicated by the arrow "a") and (iii) on the same side as the engagement projection 316. The first interference convex part 320 is provided on the lower side than one of the guided parts 312 (provided on one side which is distant from the image forming agent storage body 110) so as to overlap the guided part 312 in the up and down direction. When the opening-and-closing member 310 located in the position where the opening-and-closing member 310 closes the discharge port 114 moves so as to slant relative to the image forming agent storage body 110, the first interference convex part 320 interferes with the interference concave part 156.

A first move convex part 330 is formed on the outer side of the opening-and-closing member 310 and in the front end side, based on the insertion direction in which the image forming agent storage device 100 is inserted into the insertion part 500 (direction indicated by the arrow "a"), of the opening-and-closing member 310. The first move convex part 330 is formed only on the lower side of the outer face of the opening-and-closing member 310 (on one side which is distant from the image forming agent storage body 110) in the up and down direction.

A second move convex part 332 is formed on the outer side of the opening-and-closing member 310 and on the rear end side, based on the insertion direction in which the image forming agent storage device 100 is inserted into the insertion part 500 (direction indicated by the arrow "a"), of the opening-and-closing member 310. The second move convex part 332 is formed only on the upper side of the outer face of the opening-and-closing member 310 (on one side closer to the image forming agent storage body 110) in the up and down direction. When the image forming agent storage device 100 is inserted into the insertion part 500, the first move convex part 330 and the second move convex part 332 are used to move the opening-and-closing member 310, relative to the image forming agent storage body 110, in the direction crossing the insertion direction in which the image forming agent storage device 100 is inserted into the insertion part 500 (the direction indicated by the arrow "a").

A second interference convex part 322 is formed (i) on the inner surface side of the opening-and-closing member 310, which is opposed to the opening-and-closing member support part 140, (ii) in the rear end, which is based on the insertion direction in which the image forming agent storage device 100 is inserted into the insertion part 500 (direction indicated by the arrow "a"), of the opening-and-closing member 310 and (iii) on the opposite side to the engagement projection 316. The second interference convex part 322 is formed so as to project toward the inside of the opening-and-closing member 310 in the direction orthogonal to the insertion direction. The second interference convex part 322 is used to prevent the opening-and-closing member 310, which is located in the position where the opening-and-closing member 310 closes the discharge port 114, from slanting with respect to the image forming agent storage body 110.

A projection part 350 is formed (i) on the inner surface side of the opening-and-closing member 310, which is opposed to the opening-and-closing member support part 140, (ii) roughly at the center, for example, which is based on the insertion direction in which the image forming agent storage device 100 is inserted into the insertion part 500 (direction indicated by the arrow "a"), of the opening-and-closing member 310 and (iii) on the opposite side to the engagement projection 316. The projection part 350 is formed so as to project toward the inside of the opening-and-closing member 310 in the direction orthogonal to the insertion direction.

In the opening-and-closing member 310, which is configured as described above, in a state where the opening-and-closing member 310 closes the discharge port 114, the engagement projection 316 of the opening-and-closing member 310 enters the engagement concave part 148 of the opening-and-closing member support part 140 as shown in FIG. 10. Thus, in a state where the opening-and-closing member 310 closes the discharge port 114, if the opening-and-closing member 310 receives a force in a direction in which the opening-and-closing member 310 is pulled out from the opening-and-closing member support part 140 (a direction opposite to the insertion direction in which the image forming agent storage device 100 is inserted into the insertion part 500; a direction indicated by an arrow "c" in FIG. 10) or if the tubular body 116 provided with the opening-and-closing member support part 140 receives a force in a direction in which the tubular body 116 is pulled out from the opening-and-closing member 310 (a direction indicated by an arrow "d"), the engagement projection 316 and the engagement concave part 148 interfere and engage with each other so as to prevent a motion of the opening-and-closing member 310 or a motion of the tubular body 116 in a pulling-out direction and to prohibit the discharge port 114 from opening.

Thus, in the state where the opening-and-closing member 310 closes the discharge port 114, if an attempt is made to pull out the opening-and-closing member 310 in the arrow "c" direction or pull out the tubular body 116 in the arrow "d" direction, a state where the opening-and-closing member 310 and the image forming agent storage body 110 can engage with each other is kept, and the discharge port 114 does not open.

Thus, the engagement concave part 148, which is used as the engagement part, and the engagement projection 316, which is used as the engaged part being able to engage with the engagement concave part 148, constitute an engagement mechanism 420. In the state where the opening-and-closing member 310 closes the discharge port 114, that is, in the state where the engagement concave part 148 and the engagement projection 316 can engage with each other, the engagement mechanism 420 prohibits the discharge port 114 from opening. On the other hand, if the state where the engagement concave part 148 and the engagement projection 316 can engage with each other is released in the engagement mechanism 420, the opening-and-closing member 310 is allowed to open so that the opening-and-closing member 310 opens the discharge port 114. How the engagement between the engagement concave part 148 and the engagement projection 316 is released will be described later.

Here, it is assumed that an external force F1 is applied to a portion on the forward end side based on the insertion direction of the image forming agent storage device 100 (the direction indicated by the arrow "a") and on the opposite side to the engagement mechanism 420 as shown in FIG. 10. In this case, the second interference convex part 322 comes into contact with and interferes with a side wall part of the opening-and-closing member support part 140, and thus the opening-and-closing member 310 is prevented from rotating clockwise in FIG. 10 and from slantingly moving relative to the tubular body 116. If the opening-and-closing member 310 rotates clockwise in FIG. 10, it is concerned that the engagement between the engagement projection 316 and the engagement concave part 148 might be released in the engagement mechanism 420; in this exemplary embodiment, however, the second interference convex part 322 is formed, so that this concern of releasing the engagement in the engagement mechanism 420 is reduced.

Then, it is assumed that an external force F2 is applied to a portion on the forward end side, based on the insertion direction of the image forming agent storage device 100 (direction indicated by the arrow "a"), of the opening-and-closing member 310 and on the same side as the engagement mechanism 420 as shown in FIG. 10. In this case, the first interference convex part 320 interferes with the interference concave part 156, and the opening-and-closing member 310 is prevented from rotating counterclockwise in FIG. 10 and from slantingly moving relative to the tubular body 116. If the opening-and-closing member 310 rotates counterclockwise in FIG. 10, it is concerned that the engagement between the engagement projection 316 and the engagement concave part 148 might be released in the engagement mechanism 420; in this exemplary embodiment, however, the first interference convex part 320 and the interference concave part 156 are formed, so that this concern of releasing the engagement in the engagement mechanism 420 is reduced.

As described above, the first interference convex part 320 and the interference concave part 156 constitute an engagement release prevention mechanism 440 that prevents the state where the engagement concave part 148 and the engagement projection 316 can engage with each other from being released due to an event that a front side 340, which is based on a direction in which the opening-and-closing member 310 moves to open the discharge port 114 (the arrow "c" direction), of the opening-and-closing member 310 slantingly moves in the opposite direction to the engagement concave part 148 and the engagement projection 316 (namely, a direction being away from the engagement concave part 148 and the engagement projection 316), relative to the image forming agent storage body 110.

The second interference convex part 322 constitutes a engagement release prevention sub-mechanism 450 that prevents the state where the engagement concave part 148 and the engagement projection 316 can engage with each other from being released due to an event that the front side 340, based on the direction in which the opening-and-closing member 310 moves to open the discharge port 114 (the arrow "c" direction), of the opening-and-closing member 310 slantingly moves in the direction toward the engagement concave part 148 and the engagement projection 316 (namely, a direction approaching to the engagement concave part 148 and the engagement projection 316), relative to the image forming agent storage body 110.

A positional relationship among the projection part 350, the engagement mechanism 420, and the engagement release prevention mechanism 440 is as follows. That is, the engagement mechanism 420 and the engagement release prevention mechanism 440 are provided on one side of the opening-and-closing member 310 (the left side in FIG. 10) in an orthogonal direction to the moving direction in which the opening-and-closing member 310 moves to open the discharge port 114 (the arrow "c" direction). Also, the projection part 350 is provided on the other side of the opening-and-closing member 310 (the right side in FIG. 10) in the orthogonal direction as shown in FIG. 10. The projection part 350 is formed to project toward the left side in FIG. 10, which corresponds to the one side of the opening-and-closing member 310, from the right side in FIG. 10, which corresponds to the other side of the opening-and-closing member 310. The projection part 350 is formed to project toward the space between the engagement mechanism 420 and the engagement release prevention mechanism 440, which are provided on the one side of the opening-and-closing member 310.

Figure 11A:
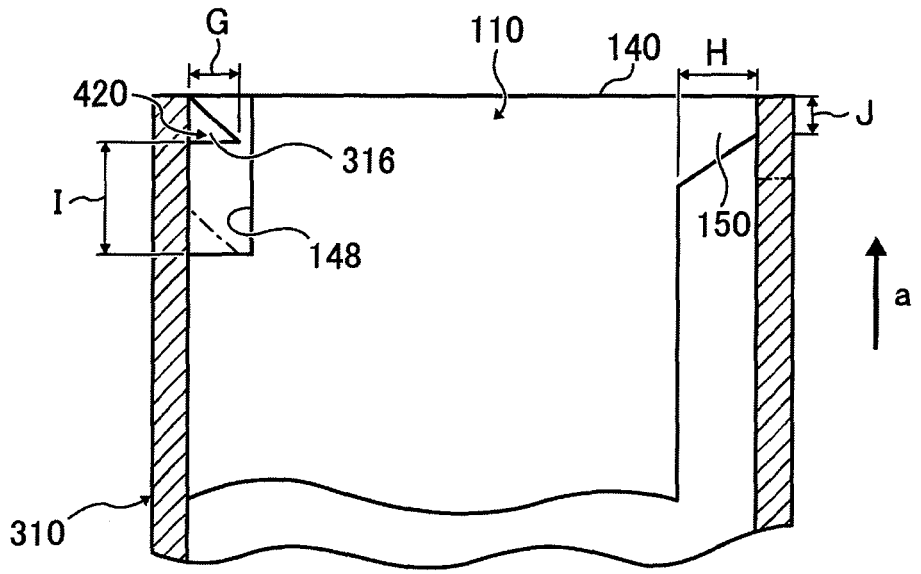
FIGS. 11A and 11B show an engagement mechanism 420 that is provided in the image forming agent storage device shown in FIG. 2.
Figure 11B:
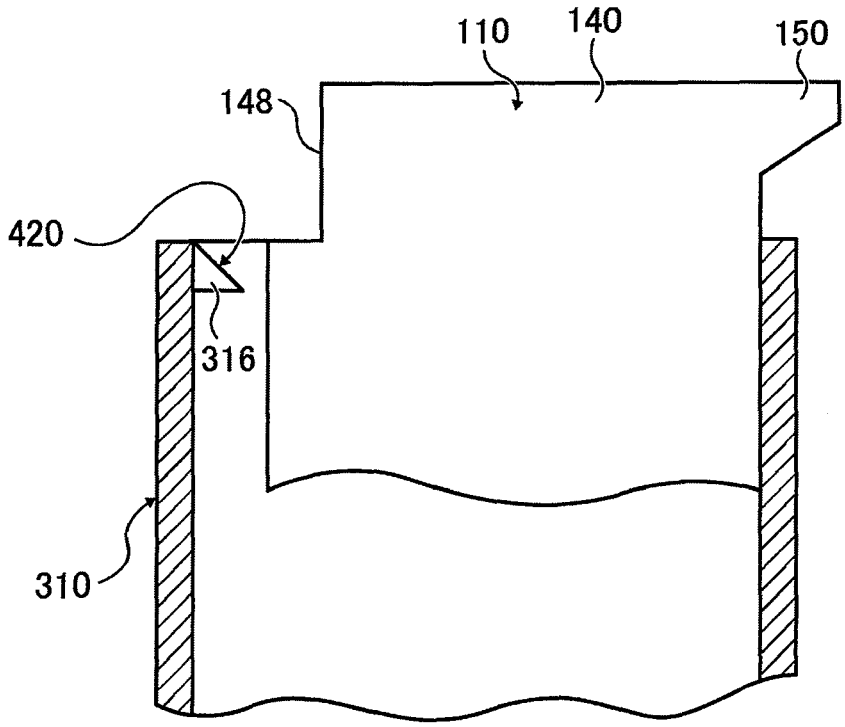

FIGS. 11A and 11B show the engagement mechanism 420. FIG. 11A shows the engagement mechanism 420 in which the engagement concave part 148 and the engagement projection 316 can engage with each other. FIG. 11B shows the engagement mechanism 420 in which the state where the engagement concave part 148 and the engagement projection 316 can engage with each other is released. As shown in FIG. 11A, a length G, in the direction orthogonal to the insertion direction (the arrow "a" direction) in which the image forming agent storage device 100 is inserted into the insertion part 500 (arrow "a" direction), of the engagement part between the engagement projection 316 and the engagement concave part 148 is formed shorter than a length H in which the opening-and-closing member 310 can move in the direction orthogonal to the insertion direction relative to the opening-and-closing member support part 140. A length I by which the engagement projection 316 entering the engagement concave part 148 can move in the engagement concave part 148 is formed longer than a length J of the front end portion of the guide convex part 150 in the insertion direction.

In addition to applying a force in the pulling-out direction (the direction indicated by the arrow "c" shown in FIG. 10) to the opening-and-closing member 310 or applying a force in the pulling-out direction (the direction indicated by the arrow "d") to the tubular body 116, if a force in a direction crossing the above forces is applied to the opening-and-closing member 310 or the image forming agent storage body 110, the state where the engagement concave part 148 and the engagement projection 316 can engage with each other is sometimes released in the engagement mechanism 420. In this case, the opening-and-closing member 310 or the image forming agent storage body 110 moves by a length equal to or greater than the length J of the front end portion of the guide convex part 150 in the insertion direction and then, the opening-and-closing member 310 moves in the direction crossing the insertion direction relative to the opening-and-closing member support part 140, and the engagement projection 316 is detached from the engagement concave part 148. As the engagement projection 316 is detached from the engagement concave part 148, the state where the engagement concave part 148 and the engagement projection 316 can engage with each other is released, which opens the opening-and-closing member 310 so as to open the discharge port 114, as shown in FIG. 11B.

Figure 12:
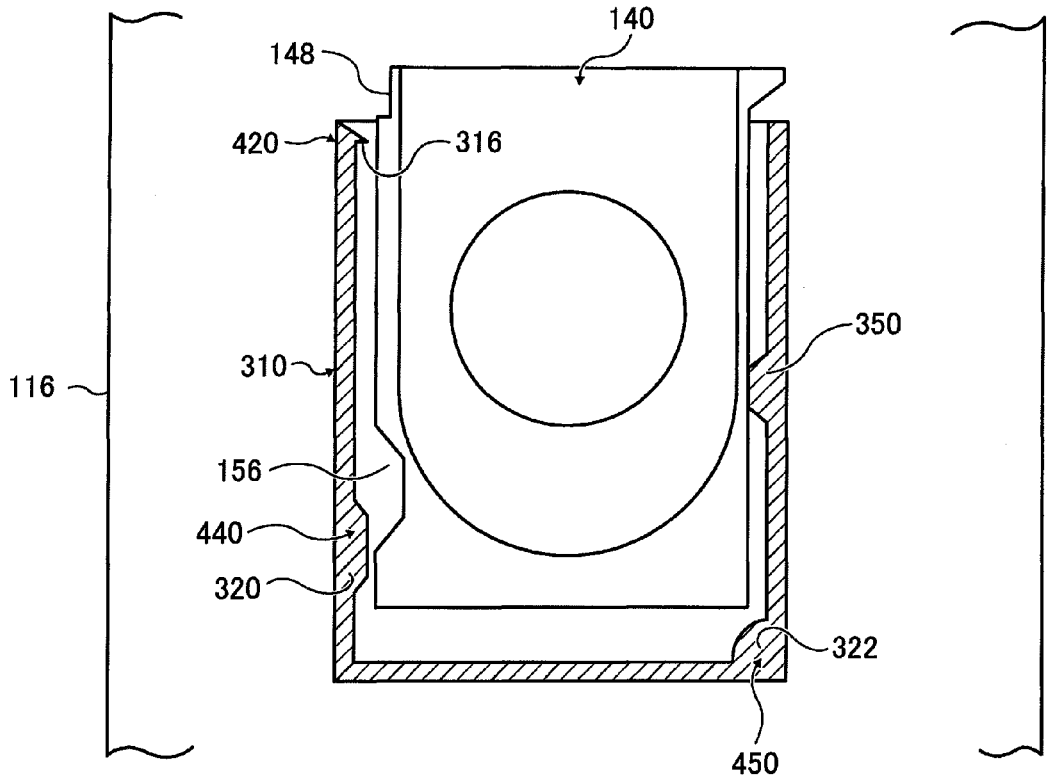
FIG. 12 is a first drawing for explaining a function of a projection part formed in the opening-and-closing member shown in FIG. 8.
Figure 13:
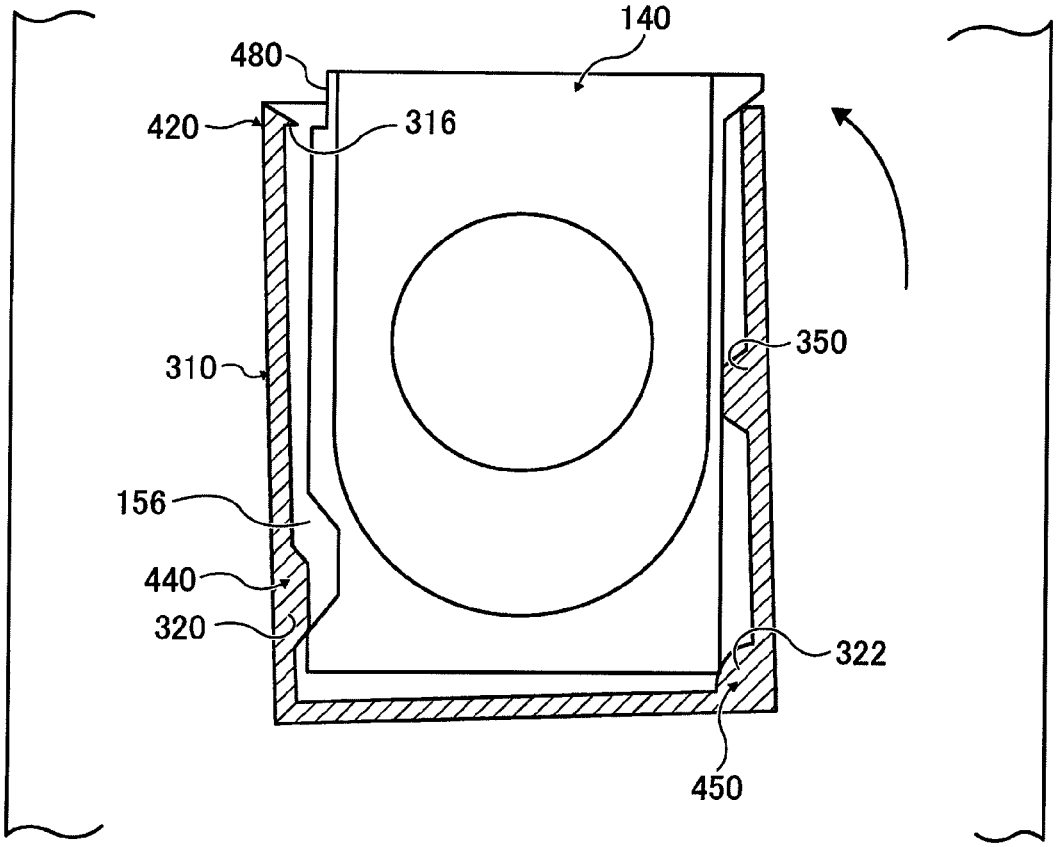
FIG. 13 is a second drawing for explaining the function of a projection part formed in the opening-and-closing member shown in FIG. 8.
Figure 14:
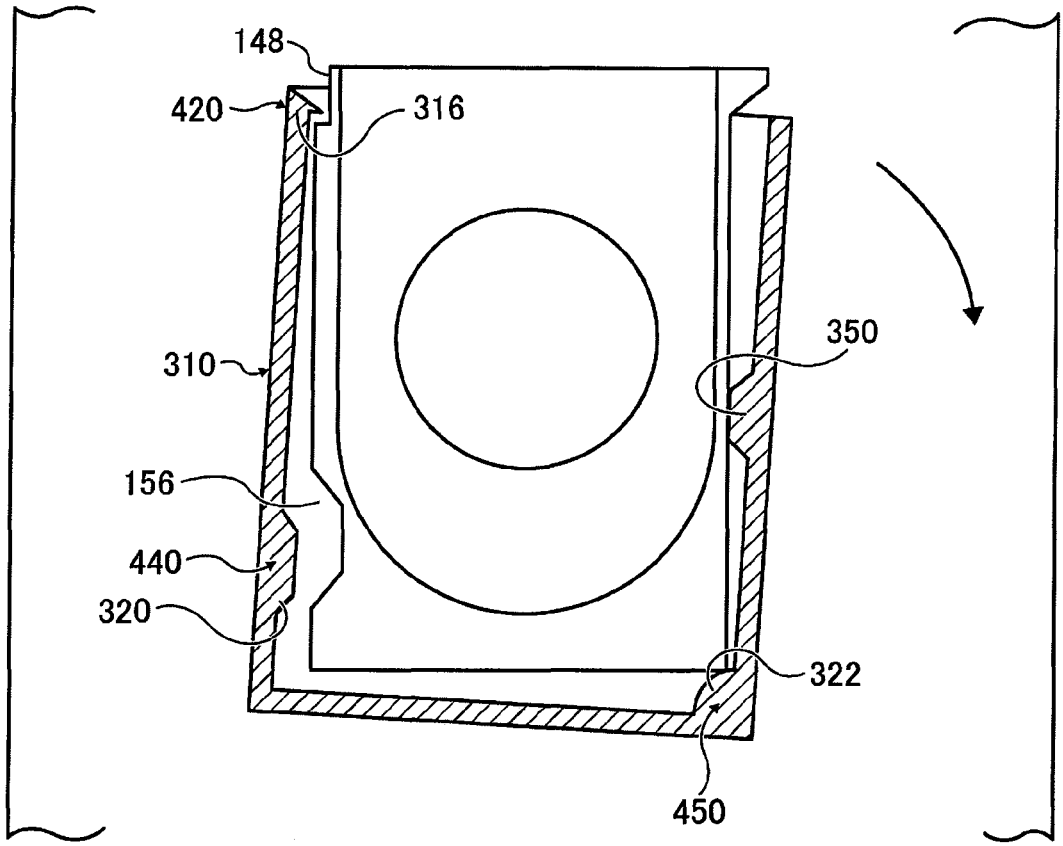
FIG. 14 is a third drawing for explaining the function of a projection part formed in the opening-and-closing member shown in FIG. 8.

FIGS. 12 to 14 show a function of the projection part 350.

As shown in FIG. 12, if the opening-and-closing member 310 is opened so as to open the discharge port 114, the state where the engagement concave part 148 and the engagement projection 316 can engage with each other is released in the engagement mechanism 420. Then, when the opening-and-closing member 310 moves to the lower side in FIG. 12 relative to the opening-and-closing member support part 140, since the projection part 350 is provided, a distance between the opening-and-closing member 310 and the opening-and-closing member support part 140 becomes narrow and thus, the opening-and-closing member 310 becomes hard to rattle.

As shown in FIG. 13, when the opening-and-closing member 310 is opened so as to open the discharge port 114, if the opening-and-closing member 310 rotates counterclockwise in FIG. 13 and slantingly moves, the projection part 350 comes into contact with the opening-and-closing member support part 140, and the opening-and-closing member 310 further rotates about the projection part 350 counterclockwise in FIG. 13 with the projection part 350 serving as a fulcrum in association with a move of the opening-and-closing member 310 in the direction opening the discharge port 114. As the opening-and-closing member 310 further rotates about the projection part 350 counterclockwise, it becomes easy for the first interference convex part 320 to interfere with the interference concave part 156. That is, since the projection part 350 is formed, it becomes easy for the engagement release prevention mechanism 440 to operate as compared with the case where the projection part 350 is not formed.

As shown in FIG. 14, when the opening-and-closing member 310 is opened so as to open the discharge port 114, if the opening-and-closing member 310 rotates clockwise in FIG. 14 and slantingly moves, the projection part 350 comes into contact with the opening-and-closing member support part 140, and the opening-and-closing member 310 further rotates about the projection part 350 clockwise in FIG. 14 with the projection part 350 serving as a fulcrum in association with a move of the opening-and-closing member 310 in the direction opening the discharge port 114. As the opening-and-closing member 310 further rotates on the projection part 350 clockwise, it becomes hard to release the engagement between the engagement projection 316 and the engagement concave part 148. That is, since the projection part 350 is formed, it becomes easy for the engagement mechanism 420 to operate as compared with the case where the projection part 350 is not formed.

Figure 15:
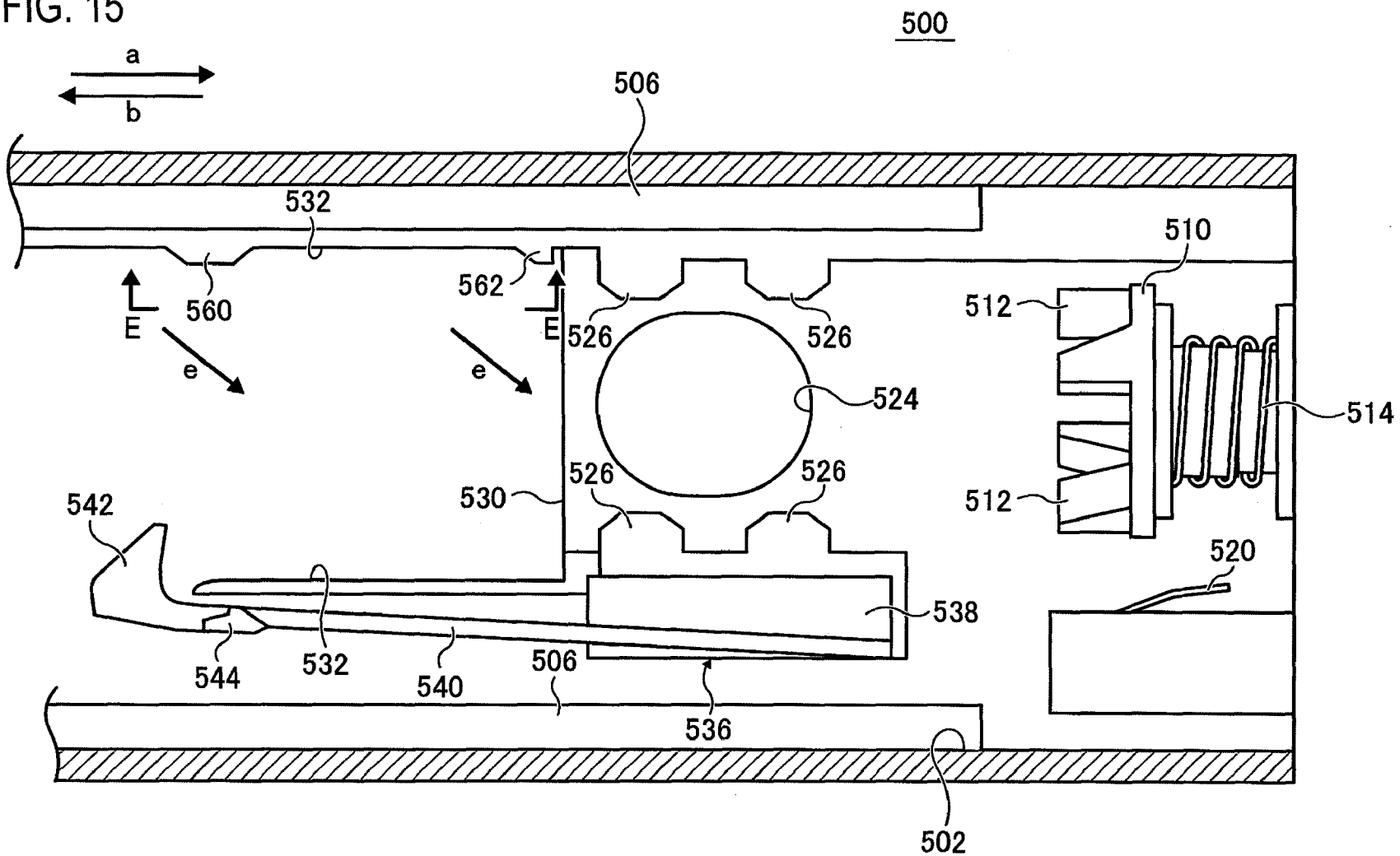
FIG. 15 is a sectional view, taken along a line D-D in FIG. 1, of an insertion part that is provided in the image forming apparatus shown in FIG. 1.

FIG. 15 shows the insertion part 500. As shown in FIG. 15, the insertion part 500 is formed with an acceptance port 502. The acceptance port 502 has a diameter slightly larger than the image forming agent storage device 100 and is in parallel to the insertion direction of the image forming agent storage device 100 indicated by an arrow "a" in FIG. 15, that is, the direction from the front side of the image forming apparatus 6 to the rear side of the image forming apparatus 6. The guide parts 506 are formed on both sides of an inner wall faces of the acceptance port 502. The guide parts 506 guide the move regulation part 166, which is previously described with reference to FIG. 6.

A coupled part (second coupling) 510 is provided in a front end of the insertion part 500 in the insertion direction. The coupled part 510 rotates upon reception of a drive force from a drive source (not shown) provided in the image forming apparatus main body 8. The coupled part 510 is formed with plural coupling projections 512 at predetermined intervals in the circumferential direction of the circumference having a rotation axis as its center. The coupling projections 512 engage with the coupling projections 124 of the coupling part 120 described above, and the coupling part 120 and the coupled part 510 are coupled for transmitting the rotation force to the coupling part 120 so as to rotate the agitation member 126. The coupled part 510 is supported movably in the insertion direction in which the image forming agent storage device 100 is inserted into the insertion part 500 and is urged to the opposite side to the insertion direction of the image forming agent storage device 100 by an urging member 514 such as a coil spring.

When the insertion direction in which the image forming agent storage device 100 is inserted into the insertion part 500 (the arrow "a" direction) is set as a reference, a terminal 520 corresponding to the connection part 132 of the storage medium 130 described above is provided on a side of the coupled part 510 in a direction perpendicular to the insertion direction. The terminal 520 is formed of an elastic member having conductivity, such as a plate spring. If the image forming agent storage device 100 is completely inserted into the insertion part 500, the terminal 520 presses the connection part 132 of the storage medium 130 so as to elastically urge the connection part 132 and is connected to the connection part 132.

The insertion part 500 is formed with a developer acceptance port 524. More specifically, when the insertion direction in which the image forming agent storage device 100 is inserted into the insertion part 500 is set as a reference, the developer acceptance port 524 is formed on a low side slightly back from a front end of the acceptance port 502 in the insertion direction. The developer acceptance port 524 has a diameter slightly larger than the discharge port 114 of the image forming agent storage body 110 described above and has a long hole shape elongating in the insertion direction in which the image forming agent storage body 110 is inserted into the insertion part 500. If the image forming agent storage device 100 is completely inserted into the insertion part 500, the developer acceptance port 524 is connected to the discharge port 114 of the image forming agent storage body 110.

Plural second guide parts 526 are formed in the surrounding of the developer acceptance port 524 of the insertion part 500. Each of the second guide parts 526 projects toward the developer acceptance port 524 in the direction orthogonal to the insertion direction in which the image forming agent storage device 100 is inserted into the insertion part 500. If the image forming agent storage device 100 is completely inserted into the insertion part 500, the second guide parts 526 enter the guide grooves 142 of the opening-and-closing member support part 140 of the image forming agent storage body 110 to guide the opening-and-closing member support part 140 in the insertion direction in which the image forming agent storage device 100 is inserted into the insertion part 500.

The insertion part 500 has a first opening-and-closing member regulation part 530. When the insertion direction in which the image forming agent storage device 100 is inserted into the insertion part 500 is set as a reference, the first opening-and-closing member regulation part 530 is formed, for example, as a wall rising in the direction orthogonal to the insertion direction on a rear side of the developer acceptance port 524 in the insertion direction (in the other words, the front side of the image forming apparatus 6). The front end face of the opening-and-closing member 310 in the insertion direction abuts against the first opening-and-closing member regulation part 530 to block a further move of the opening-and-closing member 310 in the insertion direction in which the image forming agent storage device 100 is inserted into the insertion part 500 (see FIG. 3A). The first opening-and-closing member regulation part 530 is not limited to the wall and may be shaped like any desired form such as a projection, a rod, or a rib so long as it can block the move of the opening-and-closing member 310; it is not limited to a regulation part rising in the orthogonal direction and may have an angle in a predetermined direction or may be shaped like a curved face so long as it can block the move of the opening-and-closing member 310.

The insertion part 500 has a second opening-and-closing member regulation part 532. The second opening-and-closing member regulation part 532 is formed, for example, as a pair of walls extending in parallel with the insertion direction in which the image forming agent storage device 100 is inserted into the insertion part 500 from both sides of the first opening-and-closing member regulation part 530. When the image forming agent storage device 100 is inserted into the insertion part 500, the second opening-and-closing member regulation part 532 sandwiches both side faces of the opening-and-closing member 310.

One of the wall faces of the second opening-and-closing member regulation part 532 is formed with a first press part 560 and a second press part 562 that project toward the other wall face. When the image forming agent storage body 110 is inserted into the insertion part 500, the first press part 560 and the second press part 562 are used to press the opening-and-closing member 310 in the direction crossing the insertion direction indicated by the arrow "a" and in the direction toward the other wall face, namely, in the direction of an arrow "e" in FIG. 15

The insertion part 500 has a pulling-out regulation member 536.

The pulling-out regulation member 536 has a base 538, a bend allowance part 540 extending from the base 538 in the pulling-out direction in which the image forming agent storage body 110 is pulled out from the insertion part 500 (a direction indicated by an arrow "b"), a third opening-and-closing member regulation part 542 formed at a tip end of the bend allowance part 540, and a popped-up part 544 formed in an upper part of the bend allowance part 540 slightly behind the third opening-and-closing member regulation part 542 in the pulling-out direction (in other words, the rear side of the image forming apparatus 6). The pulling-out regulation member 536 is provided along the second opening-and-closing member regulation part 532, which is placed on one side and has the base 538 fixed to the insertion part 500. The bend allowance part 540, the third opening-and-closing member regulation part 542, and the popped-up part 544 can move integrally in response to elastic deformation of the bend allowance part 540. The pulling-out regulation member 536 is placed so that at the free shape time of the bend allowance part 540, the third opening-and-closing member regulation part 542 is ahead of the second opening-and-closing member regulation part 532, which is placed on the one side, in the pulling-out direction (in other words, the front side of the image forming apparatus 6) and is placed in a position where the third opening-and-closing member regulation part 542 overlaps the second opening-and-closing member regulation part 532 placed on the one side when viewed from the front side of the image forming apparatus 6.

When the insertion direction in which the image forming agent storage device 100 is inserted into the insertion part 500 is set as a reference, the third opening-and-closing member regulation part 542 is provided with an inclined face with which the opening-and-closing member 310 comes in contact, on the rear side thereof in the insertion direction (in other words, on the front side of the image forming apparatus 6). The inclined face is directed in a direction in which it approaches the second opening-and-closing member regulation part 532 placed on the other side gradually as it goes to the front side in the insertion direction (in other words, the rear side of the image forming apparatus 6).

When the insertion direction of the image forming agent storage device 100 (the arrow "a" direction) is set as a reference, if the inclined face of the third opening-and-closing member regulation part 542 is pressed in the insertion direction at the front end of the opening-and-closing member 310 in the insertion direction and if the pop-up part 146 of the image forming agent storage body 110 (see FIG. 7) presses the popped-up part 544, the bend allowance part 540 becomes elastically deformed. If the bend allowance part 540 becomes elastically deformed and the third opening-and-closing member regulation part 542 moves back from the position at the free shape time where the third opening-and-closing overlaps the second opening-and-closing member regulation part 532, which placed on the one side, when viewed from the front side of the image forming apparatus 6, the image forming agent storage body 110 and the opening-and-closing member 310 are allowed to move.

When the image forming agent storage device 100 is pulled out from the insertion part 500, the image forming agent storage device 100 is moved in the opposite direction to the insertion direction. Thereby, the rear end of the opening-and-closing member 310 in the insertion direction abuts against the front face of the third opening-and-closing member regulation part 542 in the insertion direction, and while a move of the opening-and-closing member 310 in the opposite direction to the insertion direction is regulated, the image forming agent storage body 110 is moved in the opposite direction to the insertion direction, so that the opening-and-closing member 310 moves relative to the image forming agent storage body 110. As the opening-and-closing member 310 moves relative to the image forming agent storage body 110, the discharge port 114 is closed (see FIG. 3).

Thereafter, the bend allowance part 540 does not become elastically deformed, and the third opening-and-closing member regulation part 542 regulates a move of the opening-and-closing member 310 until the engagement projection 316 of the opening-and-closing member 310 enters the engagement concave part 148 of the opening-and-closing member support part 140 and the opening-and-closing member 310 and the image forming agent storage body 110 are placed in the positional relationship in which they can again engage with each other. When the pop-up part 146 of the image forming agent storage body 110 pops up the popped-up part 544, the bend allowance part 540 becomes elastically deformed, and the third opening-and-closing member regulation part 542 allows the opening-and-closing member 310 to move.

Figure 16:
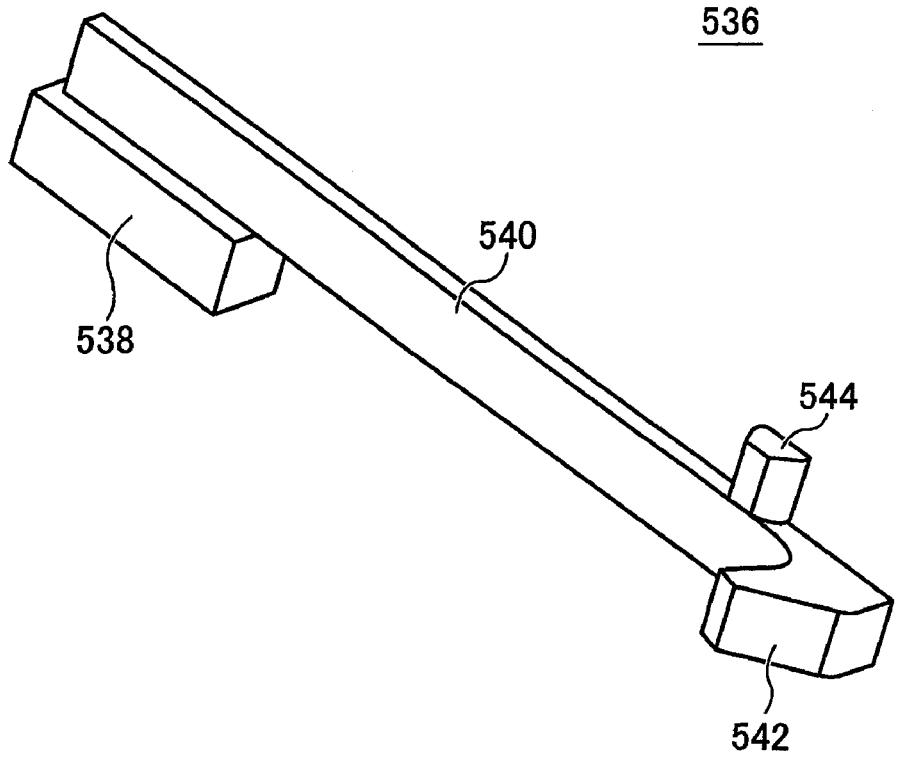
FIG. 16 is a perspective view of a pulling-out regulation member that is provided in the image forming apparatus shown in FIG. 1.

FIG. 16 is a perspective view of the pulling-out regulation member 536. The pulling-out regulation member 536 has the base 538, the bend allowance part 540, the third opening-and-closing member regulation part 542, and the popped-up part 544 as described above.

Figure 17:
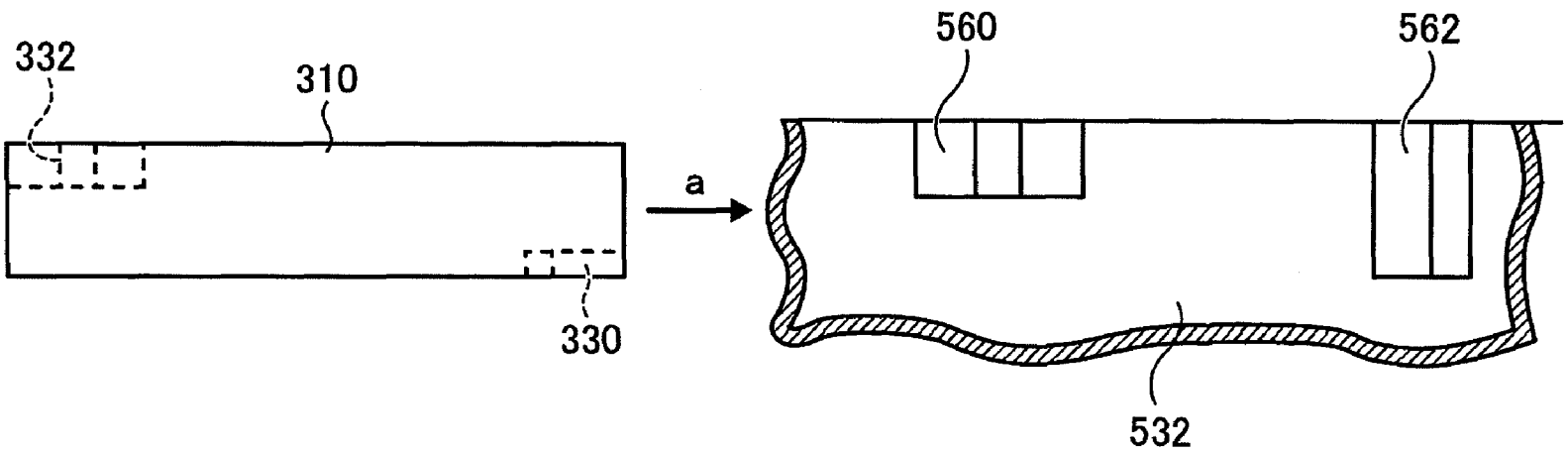
FIG. 17 is a drawing to show a part of the insertion part shown in FIG. 15 when viewed from an arrow E-E direction shown in FIG. 15.

FIG. 17 shows one wall face of the second opening-and-closing member regulation part 532. The first press part 560 and the second press part 562 are formed on the one wall face of the second opening-and-closing member regulation part 532 so as to project toward the other wall face, as described above. When the image forming agent storage body 110 is inserted into the insertion part 500, the first press part 560 and the second press part 562 are used to press the opening-and-closing member 310 in the direction crossing the insertion direction indicated by the arrow "a" and in the direction toward the other wall face, namely, in the direction of the arrow "e" in FIG. 15

Next, operation examples of inserting the image forming agent storage device 100 into the insertion part 500 and pulling out the image forming agent storage device 100 from the insertion part 500 will be described.

Figure 18:
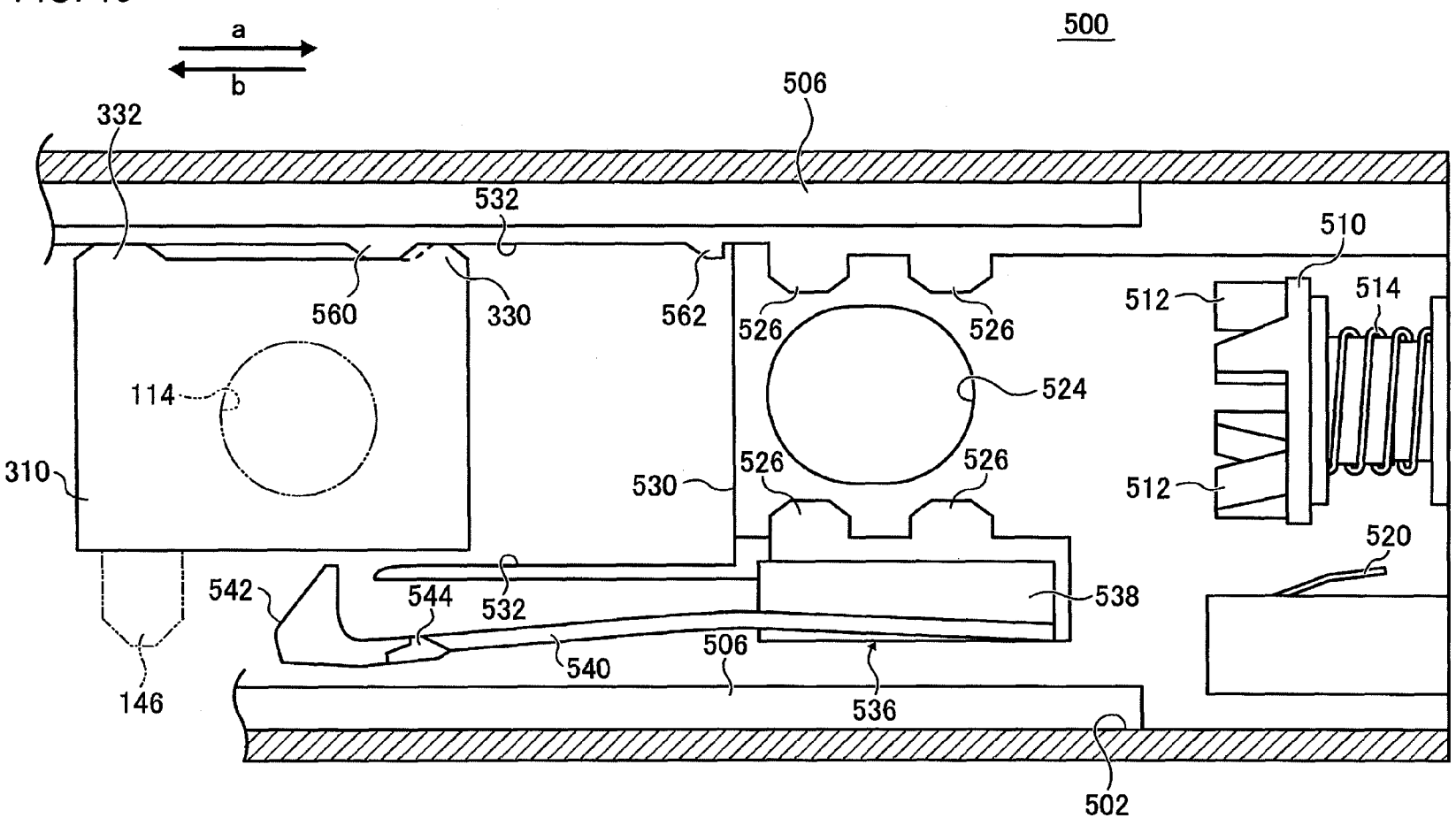
FIG. 18 is a sectional view of the insertion part to show a state where insertion of the developer storage body into the insertion part shown in FIG. 15 is started and the opening-and-closing member starts to enter a second opening-and-closing member regulation part.
Figure 19:
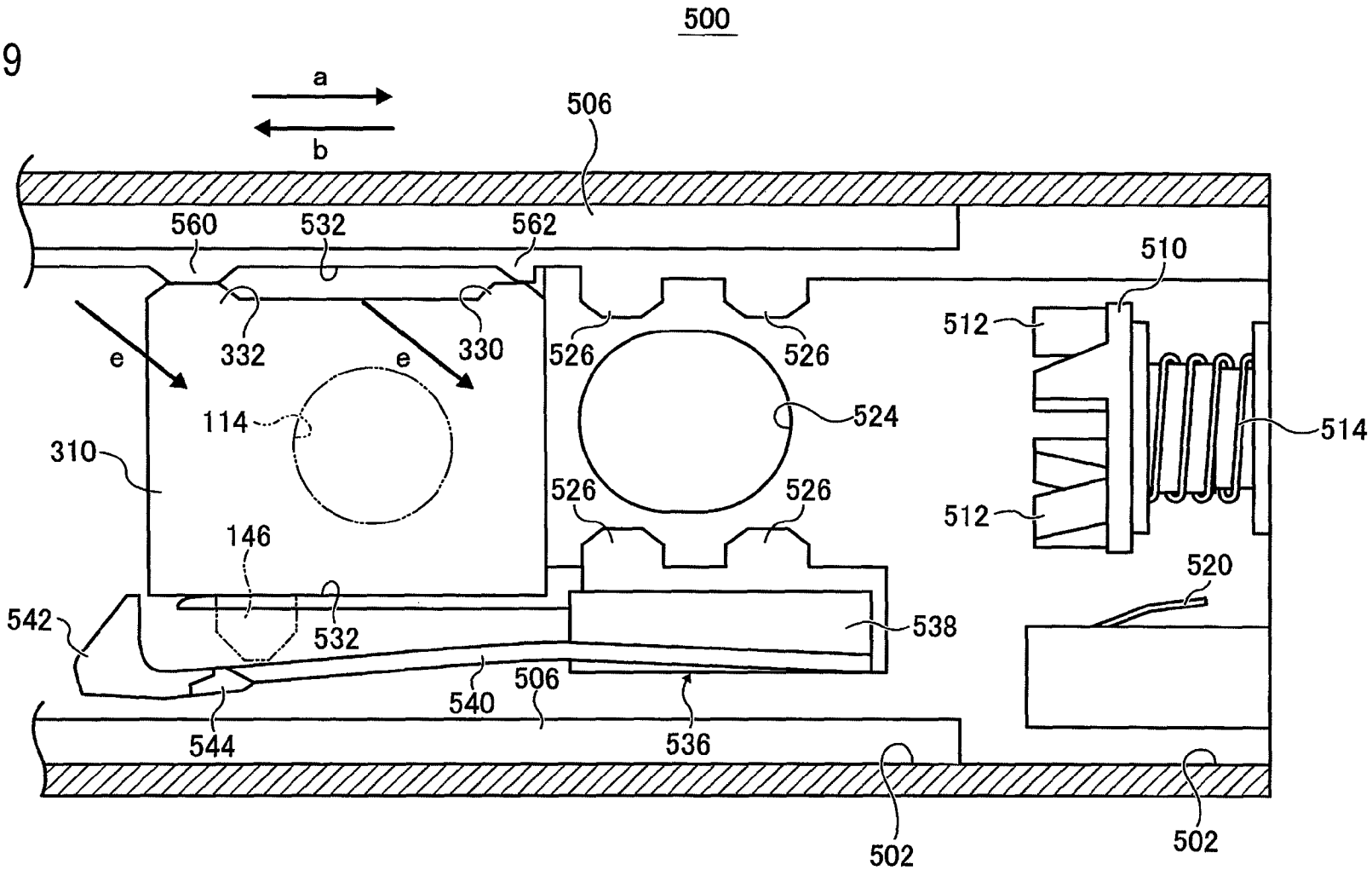
FIG. 19 is a sectional view of the insertion part to show a state where the developer storage body is inserted into the insertion part shown in FIG. 15 and the opening-and-closing member abuts against a first opening-and-closing member regulation part.
Figure 20:
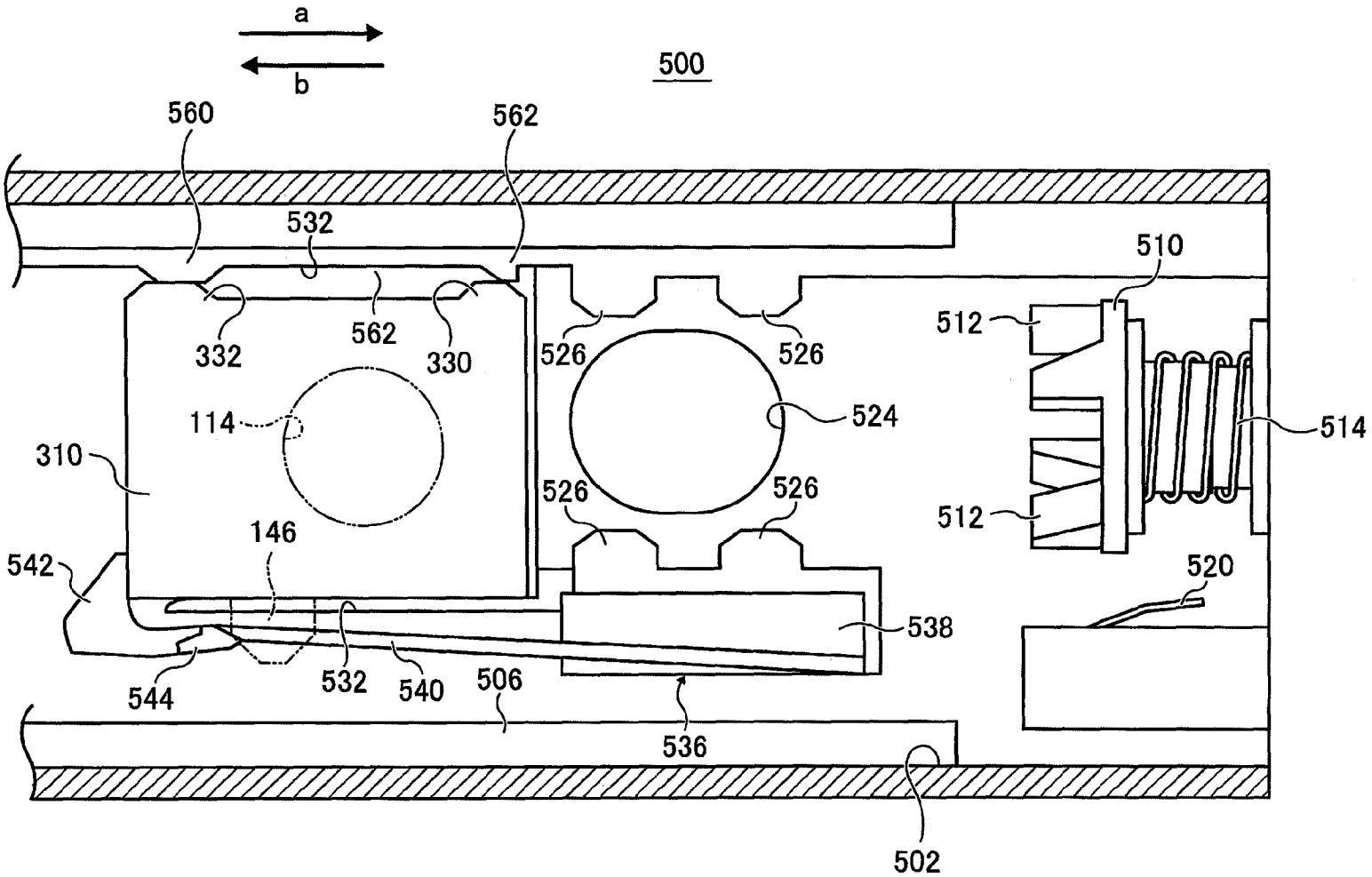
FIG. 20 is a sectional view of the insertion part to show a halfway state where the developer storage body is being pulled out from the insertion part.

FIG. 18 is a sectional view of the insertion part 500 to show a state where insertion of the image forming agent storage device 100 into the insertion part 500 is started and the opening-and-closing member 310 starts to enter the space between both sides of the second opening-and-closing member regulation part 532, FIG. 19 is a sectional view of the insertion part 500 to show a state where the opening-and-closing member 310 abuts against the first opening-and-closing member regulation part 530, and FIG. 20 is a sectional view of the insertion part 500 to show a halfway state where the image forming agent storage body 110 is being pulled out from the insertion part 500.

To attach the image forming agent storage device 100 to the insertion part 500, first a user holds the grip member 180 of the image forming agent storage device 100, inserts the image forming agent storage device 100 into the acceptance port 502, which is provided in the image forming apparatus main body 8, from the direction of the lid body 160, and pushes the image forming agent storage device 100 toward the rear side of the acceptance port 502. In this state, the image forming agent storage device 100 is guided from the front side of the image forming apparatus 6 to the rear side of the image forming apparatus 6 while the guide parts 506 are sliding on the move regulation part 166. The engagement projection 316 of the opening-and-closing member 310 enters or engages with the engagement concave part 148 of the opening-and-closing member support part 140, a motion of the opening-and-closing member 310 relative to the image forming agent storage body 110 is regulated, and the opening-and-closing member 310 is fixed and closes the discharge port 114. If the user further inserts the image forming agent storage device 100 into the acceptance port 502, one corner part at the front end of the opening-and-closing member 310 comes into contact with the inclined face formed in the third opening-and-closing member regulation part 542 of the pulling-out regulation member 536 to push the third opening-and-closing member regulation part 542, and the opening-and-closing member 310 is guided along the space between the both sides of the second opening-and-closing member regulation part 532, as shown in FIG. 18. At this time, the first move convex part 330 formed in the opening-and-closing member 310 passes below the first press part 560 formed in the second opening-and-closing member regulation part 532 without coming in contact with below the first press part 560.

If the user further inserts the image forming agent storage device 100, the front face of the front end side of the opening-and-closing member 310 in the insertion direction indicated by the arrow "a" abuts against the wall, rising in the orthogonal direction to the insertion direction, of the first opening-and-closing member regulation part 530, and a further move of the opening-and-closing member 310 in the insertion direction of the image forming agent storage device 100 is blocked, as shown in FIG. 19. If the user further inserts the image forming agent storage device 100, the front end face of the opening-and-closing member 310 is pressed against the first opening-and-closing member regulation part 530, and while a move of the opening-and-closing member 310 is blocked by the first opening-and-closing member regulation part 530, the image forming agent storage body 110 moves in the insertion direction relative to the opening-and-closing member 310.

At this time, as the opening-and-closing member 310 moves, the first move convex part 330 comes into contact with the second press part 562, and the second move convex part 332 comes into contact with the first press part 560. Accordingly, the opening-and-closing member 310 is pressed against the one wall face of the second opening-and-closing member regulation part 532 and moves in the arrow "e" direction shown in FIG. 19, which is the direction crossing the insertion direction (the arrow "a" direction) of the image forming agent storage device 100. As the opening-and-closing member 310 moves in the arrow "e" direction, in the engagement mechanism 420, the engagement projection 316 of the opening-and-closing member 310 is detached from the engagement concave part 148 of the image forming agent storage body 110, and the state where the engagement projection 316 and the engagement concave part 148 can engage with each other is released, as shown in FIG. 11.

If the user further inserts the image forming agent storage body 110 toward the rear side of the insertion part 500, the image forming agent storage body 110 is moved toward the rear side of the insertion part 500. The image forming agent storage body 110 is inserted into the insertion part 500 with the opening-and-closing member 310 being pressed against the first opening-and-closing member regulation part 530, whereby the discharge port 114 of the image forming agent storage body 110 is connected to the developer acceptance port 524 of the insertion part 500, the coupling projections 124 of the coupling part 120 and the coupling projections 512 of the coupled part 510 engage with each other, and the connection part 132 of the storage medium 130 is connected to the terminal 520 with urging of the terminal 520.

Next, to pull out the image forming agent storage device 100 from the insertion part 500, the user holds the grip member 180 of the image forming agent storage device 100 and starts to pull out the image forming agent storage device 100. Then, the coupling between the coupling part 120 and the coupled part 510, the connection between the storage medium 130 and the terminal 520, and the connection between the discharge port 114 and the developer acceptance port 524 are released. At this time, the rear end of the opening-and-closing member 310 in the insertion direction abuts against the third opening-and-closing member regulation part 542 of the pulling-out regulation member 536 and is pressed thereagainst, as shown in FIG. 20. Thus, the image forming agent storage body 110 moves as it is pulled out in a state where a move of the opening-and-closing member 310 is blocked, whereby the opening-and-closing member 310 moves, relative to the image forming agent storage body 110, to the position where the opening-and-closing member 310 seals the discharge port 114. The image forming agent storage device 100 is pulled out from the insertion part 500 in a state where the opening-and-closing member 310 seals the discharge port 114.

In the first exemplary embodiment of the invention described above, the engagement release prevention mechanism 440 has the first interference convex part 320 formed in the opening-and-closing member 310 and the interference concave part 156 formed in the image forming agent storage body 110, and the first interference convex part 320 and the interference concave part 156 can engage with each other. However, the engagement release prevention mechanism 440 may be configured so as to have a recess part formed in the opening-and-closing member 310 and a convex part formed in the image forming agent storage body 110.

Figure 21:
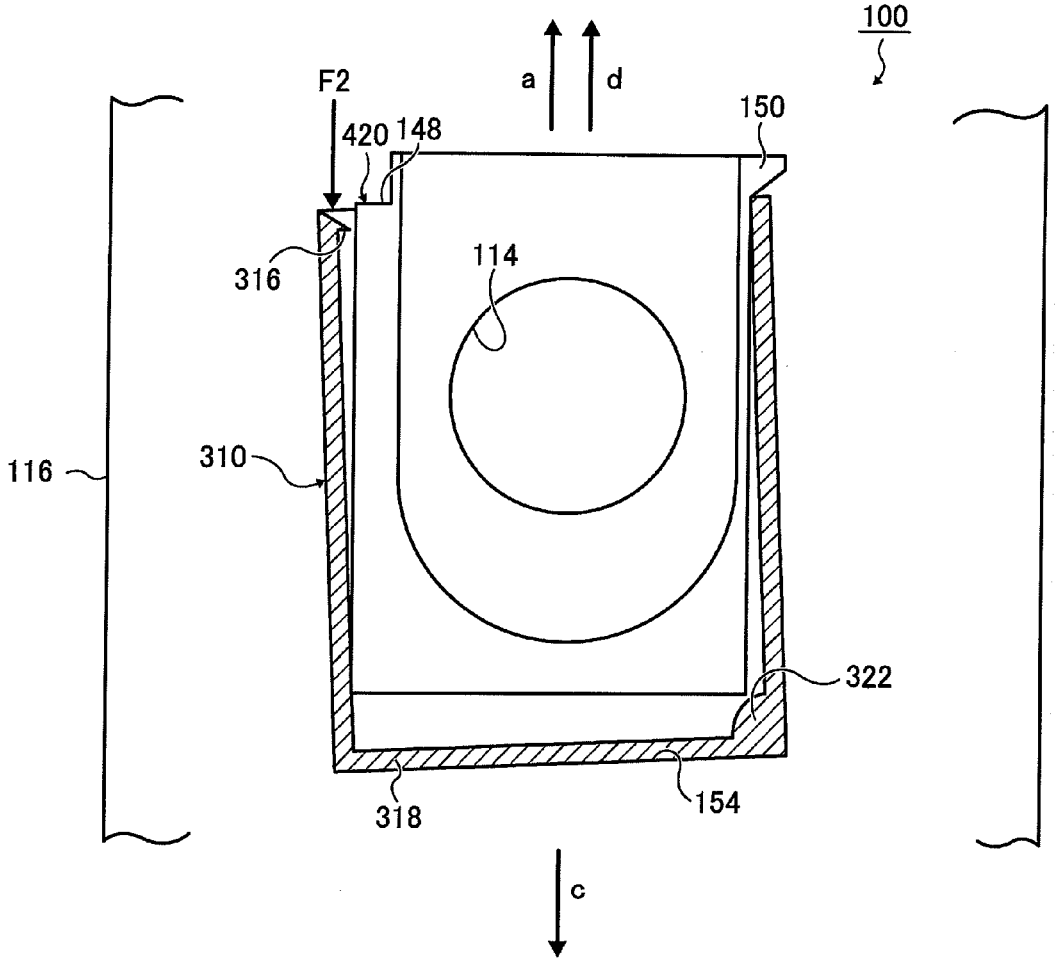
FIG. 21 is a drawing to show an image forming agent storage device according to a first comparison example.

FIG. 21 shows an image forming agent storage device 100 according to a first comparison example.

In the image forming agent storage device according to the first exemplary embodiment described above, the first interference convex part 320 and the interference concave part 156 are formed for preventing the opening-and-closing member 310 from rotating counterclockwise in FIG. 21. Thus, if the external force F2 is applied to the portion on the front end side, based on the insertion direction in which the image forming agent storage device 100 is inserted into the insertion part 500 (the direction indicated by the arrow "a"), and on the same side as the engagement mechanism 420, the engagement mechanism 420 is not released. In contrast, the image forming agent storage device 100 according to the first comparison example is formed with neither the first interference convex part 320 nor the interference concave part 156. Thus, if the external force F2 is applied to an opening-and-closing member 310, the opening-and-closing member 310 rotates as shown in FIG. 21, and there is a fear that a state where an engagement projection 316 and an engagement concave part 148 can engage with each other would be released.

Figure 22:
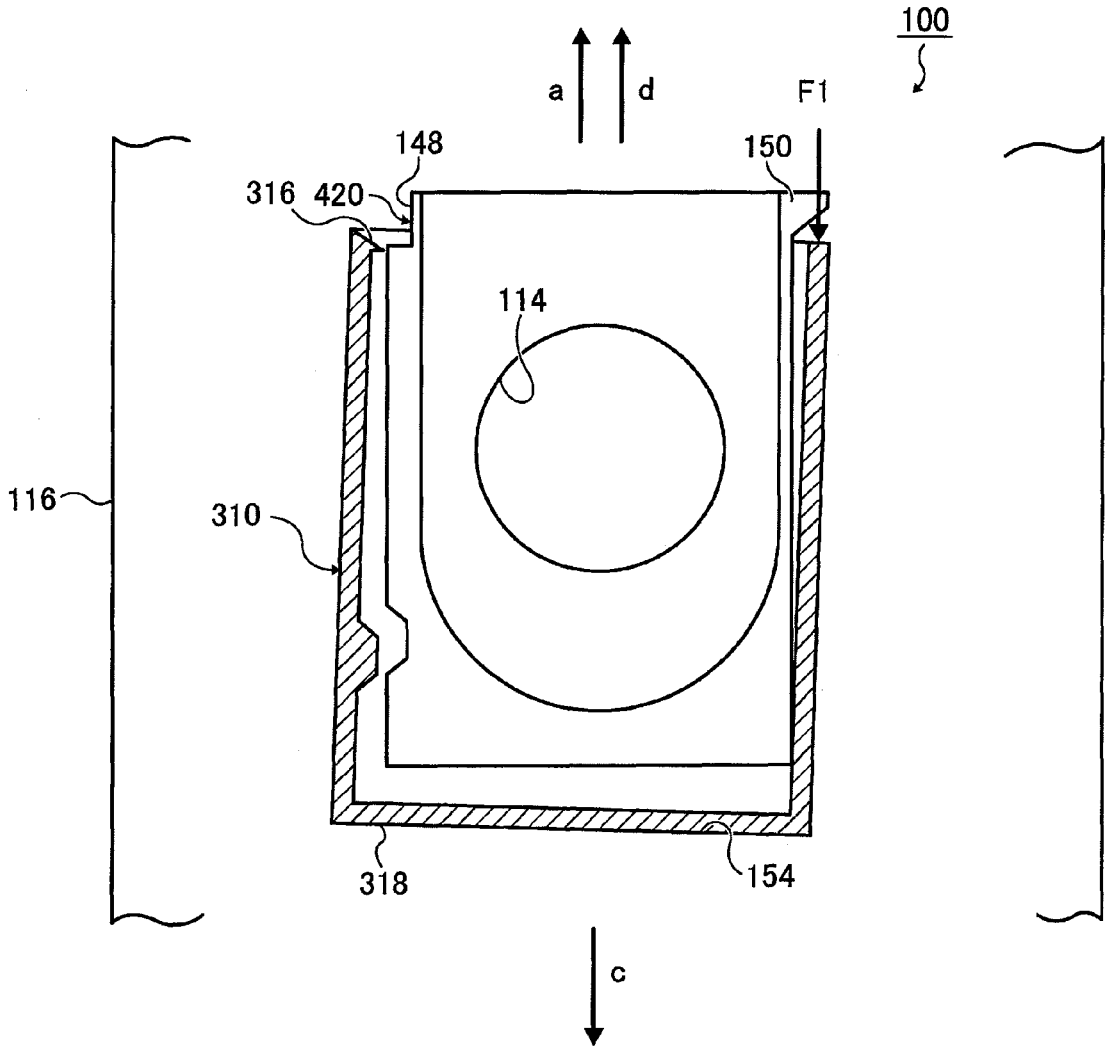
FIG. 22 is a drawing to show an image forming agent storage device according to a second comparison example.

FIG. 22 shows an image forming agent storage device 100 according to a second comparison example.

In the image forming agent storage device according to the first exemplary embodiment described above, the second interference convex part 322 is formed to prevent the opening-and-closing member 310 from rotating clockwise in FIG. 22. Thus, if the external force F1 is applied to the portion on the front end side, based on the insertion direction in which the image forming agent storage device 100 is inserted into the insertion part 500 (the direction indicated by the arrow "a"), and on the opposite side to the engagement mechanism 420, the engagement mechanism 420 is not released. In contrast, the image forming agent storage device 100 according to the second comparison example is not formed with the second interference convex part 322. Thus, if the external force F1 is applied to an opening-and-closing member 310, the opening-and-closing member 310 rotates as shown in FIG. 22, and there is a fear that a state where an engagement projection 316 and an engagement concave part 148 can engage with each other would be released.

Figure 23:
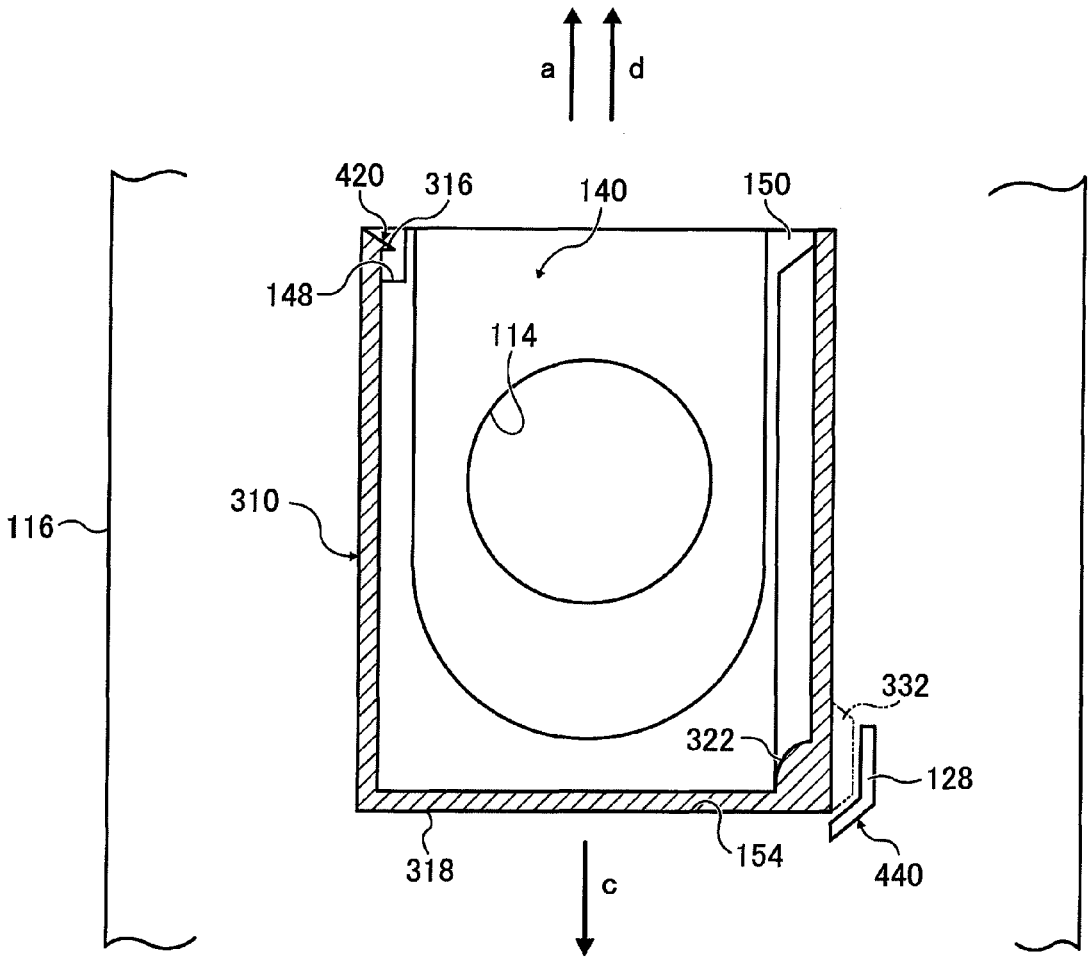
FIG. 23 is a drawing to show an image forming agent storage device according to a second exemplary embodiment of the invention.

FIG. 23 shows an image forming agent storage device 100 according to a second exemplary embodiment of the invention.

In the image forming agent storage device according to the first exemplary embodiment described above, the first interference convex part 320 and the interference concave part 156 are formed, and the first interference convex part 320, the interference concave part 156, and the second interference convex part 322 constitute the engagement release prevention mechanism 440. Particularly, the first interference convex part 320 and the interference concave part 156 prevent the opening-and-closing member 310 from rotating counterclockwise in FIG. 23. In contrast, in the image forming agent storage device 100 according to the second exemplary embodiment of the invention, a tubular body 116 is formed with an interference projection 128. The interference projection 128 and a second interference convex part 322 constitute an engagement release prevention mechanism 440.

The interference projection 128 is formed on the tubular body 116 so as to be adjacent to a second move convex part 332, for example, of an opening-and-closing member 310. If the opening-and-closing member 310 attempts to rotate counterclockwise in FIG. 23, the interference projection 128 interferes with the opening-and-closing member 310. Thus, the interference projection 128 prevents the opening-and-closing member 310 from rotating counterclockwise in FIG. 23.

As described above, the invention can be applied to an image forming apparatus such as a copier, a printer, and a facsimile machine, and an image forming agent storage device for use in the image forming apparatus.

DESCRIPTION OF REFERENCE NUMERALS

6: Image forming apparatus
10: Image forming section
100: Image forming agent storage device
110: Image forming agent storage body
114: Discharge port
128: Interference projection
148: Engagement concave part
150: Guide convex part
156: Interference concave part
316: Engagement projection
320: Interference convex part
322: Interference convex part
330: Move convex part
350: Projection part
420: Engagement mechanism
440: Engagement release prevention mechanism
450: Engagement release prevention sub-mechanism
500: Insertion part

What is claimed is:

1. An image forming agent storage device comprising:

an image forming agent storage body that is inserted into an insertion part provided in an image forming apparatus main body, that stores an image forming agent and that is formed with a discharge port for discharging the stored image forming agent;

an opening-and-closing member that, when the image forming agent storage body is inserted into the insertion part, opens the discharge port in association with a move of the image forming agent storage body in an insertion direction in which the image forming agent storage body is inserted into the insertion part and that, when the image forming agent storage body is pulled out from the insertion part, closes the discharge port in association with a move of the image forming agent storage body in an opposite direction to the insertion direction;

an engagement mechanism that includes an engagement part being provided in the image forming agent storage body, and an engaged part being provided in the opening-and-closing member and being capable of engaging with the engagement part, that, if a state where the engagement part and the engaged part can engage with each other is released, allows the opening-and-closing member to open and that prevents the opening-and-closing member from opening in the state where the engagement part and the engaged part can engage with each other, wherein the state where the engagement part and the engaged part can engage with each other is released in association with an event that the opening-and-closing member moves in a direction crossing the insertion direction relative to the image forming agent storage body from the state where the engagement part and the engaged part can engage with each other; and an engagement release prevention mechanism that prevents that the state where the engagement part and the engaged part can engage with each other is released due to an event that a front side, based on a direction in which the opening-and-closing member moves to open the discharge port, of the opening-and-closing member moves relative to the image forming agent storage body so as to slant in a direction away from a position where the engagement part and the engaged part are provided.

2. The image forming agent storage device according to claim 1, further comprising:

an engagement release prevention sub-mechanism that prevents that the state where the engagement part and the engaged part can engage with each other is released due to the event that the front side, based on the direction in which the opening-and-closing member moves to open the discharge port, of the opening-and-closing member moves relative to the image forming agent storage body so as to slant in a direction to the position where the engagement part and the engaged part are provided.

3. The image forming agent storage device according to claim 2, wherein the engagement release prevention mechanism includes an interference part that is provided in the opening-and-closing member, and an interfered part that is provided in the image forming agent storage body and that interferes with the interference part if the front side, based on the direction in which the opening-and-closing member moves to open the discharge port, of the opening-and-closing member moves relative to the image forming agent storage body so as to slant in the opposite direction to the direction of the engagement part and the engaged part.

4. The image forming agent storage device according to claim 3, wherein the interference part includes an interference convex part that is formed in the opening-and-closing member so as to project toward the image forming agent storage body, and the interfered part includes an interference concave part that is formed in the image forming agent storage body so that the interference convex part interferes with the interference concave part.

5. The image forming agent storage device according to claim 3, wherein the interference part includes an interference concave part that is formed in the opening-and-closing member so as to recess from a side of the image forming agent storage body, and the interfered part includes an interference convex part that is formed in the image forming agent storage body so that the interference concave part interferes with the interference convex part.

6. The image forming agent storage device according to claim 3, wherein a part of an outer face of the opening-and-closing member is used as the interference part, and the interfered part includes an interference projection formed in the image forming agent storage body so as to interfere with the part of the outer face.

7. The image forming agent storage device according to claim 1, wherein the engagement release prevention mechanism includes an interference part that is provided in the opening-and-closing member, and an interfered part that is provided in the image forming agent storage body and that interferes with the interference part if the front side, based on the direction in which the opening-and-closing member moves to open the discharge port, of the opening-and-closing member moves relative to the image forming agent storage body so as to slant in the opposite direction to the direction of the engagement part and the engaged part.

8. The image forming agent storage device according to claim 7, wherein the interference part includes an interference convex part that is formed in the opening-and-closing member so as to project toward the image forming agent storage body, and the interfered part includes an interference concave part that is formed in the image forming agent storage body so that the interference convex part interferes with the interference concave part.

9. The image forming agent storage device according to claim 7, wherein the interference part includes an interference concave part that is formed in the opening-and-closing member so as to recess from a side of the image forming agent storage body, and the interfered part includes an interference convex part that is formed in the image forming agent storage body so that the interference concave part interferes with the interference convex part.

10. The image forming agent storage device according to claim 7, wherein a part of an outer face of the opening-and-closing member is used as the interference part, and the interfered part includes an interference projection formed in the image forming agent storage body so as to interfere with the part of the outer face.

11. The image forming agent storage device according to claim 1, wherein the engagement mechanism and the engagement release prevention mechanism are provided on one side of the opening-and-closing member in a direction orthogonal to the direction in which the opening-and-closing member moves to open the discharge port, a projection part is provided on the other side of the opening-and-closing member in the orthogonal direction, and the projection part is formed to project from the other side toward the one side and to project toward a space between the engagement mechanism and the engagement release prevention mechanism, which are provided on the one side of the opening-and-closing member.

12. An image forming apparatus comprising:

an image forming apparatus main body that is provided with an insertion part;

an image forming agent storage device that is detachably provided in the insertion part; and an image forming section that is provided in the image forming apparatus main body and that forms an image using an image forming agent supplied from the image forming agent storage device, wherein the image forming agent storage device includes an image forming agent storage body that is inserted into an insertion part provided in an image forming apparatus main body, that stores an image forming agent and that is formed with a discharge port for discharging the stored image forming agent, an opening-and-closing member that, when the image forming agent storage body is inserted into the insertion part, opens the discharge port in association with a move of the image forming agent storage body in an insertion direction in which the image forming agent storage body is inserted into the insertion part and that, when the image forming agent storage body is pulled out from the insertion part, closes the discharge port in association with a move of the image forming agent storage body in an opposite direction to the insertion direction, an engagement mechanism that includes an engagement part being provided in the image forming agent storage body, and an engaged part being provided in the opening-and-closing member and being capable of engaging with the engagement part, that, if a state where the engagement part and the engaged part can engage with each other is released, allows the opening-and-closing member to open and that prevents the opening-and-closing member from opening in the state where the engagement part and the engaged part can engage with each other, wherein the state where the engagement part and the engaged part can engage with each other is released in association with an event that the opening-and-closing member moves in a direction crossing the insertion direction relative to the image forming agent storage body from the state where the engagement part and the engaged part can engage with each other, and an engagement release prevention mechanism that prevents that the state where the engagement part and the engaged part can engage with each other is released due to an event that a front side, based on a direction in which the opening-and-closing member moves to open the discharge port, of the opening-and-closing member moves relative to the image forming agent storage body so as to slant in a direction away from a position where the engagement part and the engaged part are provided.

* * * * *